US006131500A

United States Patent [19]

Moncrief

[11] Patent Number: 6,131,500

[45] Date of Patent: Oct. 17, 2000

[54] SYSTEM AND METHOD FOR PRODUCING MOTION

[76] Inventor: Rick L. Moncrief, 93 Mount Hamilton Rd., San Jose, Calif. 95014

[21] Appl. No.: 08/985,939

[22] Filed: Dec. 5, 1997

[51] Int. Cl.[7] ..... F15B 9/09

[52] U.S. Cl. ..... 91/361; 91/363 R; 91/454

[58] Field of Search ..... 91/454, 363 R, 91/361

[56] References Cited

U.S. PATENT DOCUMENTS

| | | | |
|---|---|---|---|
| 3,954,046 | 5/1976 | Stillhard | 91/361 |
| 4,416,187 | 11/1983 | Nystrom Per H. G. | 91/454 |
| 4,437,385 | 3/1984 | Kramer et al. | 91/361 |
| 4,727,791 | 3/1988 | Satoh | 91/363 R |
| 4,870,892 | 10/1989 | Thomsen et al. | 91/361 |
| 5,199,875 | 4/1993 | Trumbull | 434/62 |

OTHER PUBLICATIONS

Yeaple, "Electrohydraulci Valves and Servosystems", in Fluid Power Design Handbook (New York, Marcel Dekker, Inc. 1996) pp. 82–88.

*Primary Examiner*—F. Daniel Lopez

*Attorney, Agent, or Firm*—Ronald C. Fish; Falk & Fish

[57] ABSTRACT

This disclosure is directed to novel systems and methods for producing motion in response to a drive signal where the motion has a smooth translational reversal. The system accepts a command position signal and compares the command position signal to the actual position of a linear actuator to develop a position error that is then conditioned to produce a pair of valve drive signals that command series connected proportional valves that supply the linear actuator from a common connection of the valves with fluid flow and pressure to adjust the position of the linear actuator so as to reduce the position error by imparting motion to the linear actuator, thus imparting motion to a load. The conditioning of the valve drive signals includes the processing of the position error and the application of a quiescent drive signal to develop or nearly develop a quiescent fluid flow through the series connected valves. The quiescent drive signal can be automatically or manually developed. If gravitational force or other forces sufficient to return fluid from the translational driver, only one pair of proportional valves are needed. If the translational driver must be driven in both directions then two pairs of proportional valves are needed and are connected such that each set can produce motion in opposition directions. The system may be embodied as a driving simulation motion apparatus for entertainment or training purposes.

9 Claims, 16 Drawing Sheets

SYSTEM AND METHOD FOR PRODUCING MOTION

FIELD OF INVENTION

The present invention relates generally to motion production, and, more particularly, to novel systems and methods for producing motion in response to a drive signal for smoothly and selectively producing translational motion and reversal of motion.

BACKGROUND

Many types of motion production devices have been developed for imparting motion to a load, such as in connection with vehicle simulation equipment. Traditional vehicle simulation motion production equipment is designed to impart motion to an occupant or to occupants of a vehicle simulator in such a manner as to cause physiological sensations similar to, if not identical to, those that would be felt by an operator of a real vehicle under certain circumstances. Typically, vehicle simulation equipment is designed to emulate automobile or aircraft operation.

One of the primary and long felt problems encountered in the design of vehicle simulators has been reversal of motion. Specifically, when there is motion in one axis, the task of smoothly stopping that motion and reversing the motion along the same axis has proven to be difficult to accomplish.

Indeed, to cause the physiological sensations associated with operating a real vehicle, it is important to be able to reverse direction along any axis of motion smoothly. This is because the operators of real vehicles generally experience relatively smooth reversals and other changes in direction. For example, as a driver of a real automobile drives along a highway, the automobile will tend to smoothly oscillate up and down. Additionally, real automobiles tend to smoothly impart acceleration forces to the driver as the vehicle, from time to time, slows down or speeds up. During these periods of acceleration, the driver, as well as any other vehicle occupant, will physiologically sense certain smooth changes in direction. These smooth reversals and changes in direction and the associated acceleration forces are what traditional vehicle simulation motion production equipment strives to but has been unable to effectively, efficiently, and inexpensively emulate.

Prior attempts to create smooth reversals of direction and smooth accelerations have been largely unsuccessful. For example, many relatively low-cost, arcade-type, motion simulators are driven by an electric motor coupled to a series of gears. When this type of simulator attempts to reverse or otherwise change the simulator's direction of motion, it does so abruptly, thus imparting to the operator, or other simulator occupant, an artificial feeling unlike the smooth physiological sensations associated with operating a real vehicle. One of the primary limitations of this type of simulator is that it is gear-driven. Using gears to cause reversals and other changes of the direction of motion has certain problems associated with it, such as: the reversal of motion has a slower response time, the reversal of motion is highly abrupt, and the reversal of motion is often accompanied with clanking because of gear lash. All of these problems contribute in creating an unrealistic simulation of an actual driving experience and collectively hamper the vehicle motion simulation.

Other attempts to create realistic motion simulation devices also have certain limitations associated with them. For example, a relatively high cost motion simulation device used primarily for flight simulation has also been developed.

This device is referred to in the trade as a "hexapod" system. The hexapod system employs a high capacity pump in fluid communication with six valves with each valve being coupled to a piston/cylinder assembly. By selectively opening and closing the variable orifice valves, the piston/cylinder assemblies are driven to change the position of the load.

The hexapod piston/cylinder assemblies are unique in that they employ a piston that is designed to leak fluid. The piston/cylinder assemblies required for this type of motion simulator typically cost five to ten times as much as conventional piston/cylinder assemblies. As such, these piston/cylinder assemblies are, unfortunately, prohibitively expensive for use in many applications.

It has also been proposed to use electromagnets to impart motion in motion simulation devices. The use of electromagnets, too, is problematic because electromagnets have been found to be prohibitively expensive to produce, and operate for many applications. An additional limitation associated with the use of electromagnets to impart motion in motion simulation devices is that it has been found that electromagnets are generally unable to efficiently and accurately produce the range of forces required to satisfactorily drive motion simulation equipment.

The use of conventional four-way valves has also proven to be unsatisfactory in motion simulation devices. Specifically, four-way valves cost on the order of two to four times as much as conventional proportional valves. As such, four-way valves are prohibitively expensive for many applications, particularly in applications, such as in vehicle simulators where several valves are required. In addition to being more expensive, it has been found that four-way valves do not perform uniformly over a wide range of loads because of their fixed physical construction. As such, a 90 pound person and a 300 pound person operating the same vehicle simulator will get very different rides due to the difference in the magnitude of the loads imposed.

BRIEF SUMMARY AND OBJECTS OF THE INVENTION

In brief summary, the present invention overcomes or substantially alleviates prior art problems related to the provision of motion production and vehicle simulation equipment. The present invention provides a novel system for producing translational motion in response to a drive signal wherein the motion has a smooth translational reversal. The system generally comprises a load coupled with a linear actuator. First and second proportional valves are series connected at a series connection to smoothly control fluid flow to the linear actuator. The linear actuator is coupled to the first series connection and is smoothly driven by fluid flow through the series connection. The first and second proportional valves are controlled by a controller to selectively cause the linear actuator to impart motion to the load. Thus, in accordance with the present invention, the load may be selectively and smoothly moved by the linear actuator. The present invention also provides unique methodology for creating motion production and the simulation of vehicle operation. Accordingly, the present invention provides a novel system for smoothly and accurately imparting and reversing translational motion to a load, such as motion production or vehicle operation simulation equipment to cause physiological sensations similar to, if not identical to, those that would be felt by an operator of a vehicle under certain conditions.

DETAILED DESCRIPTION OF THE ILLUSTRATED EMBODIMENTS

Figure 1:
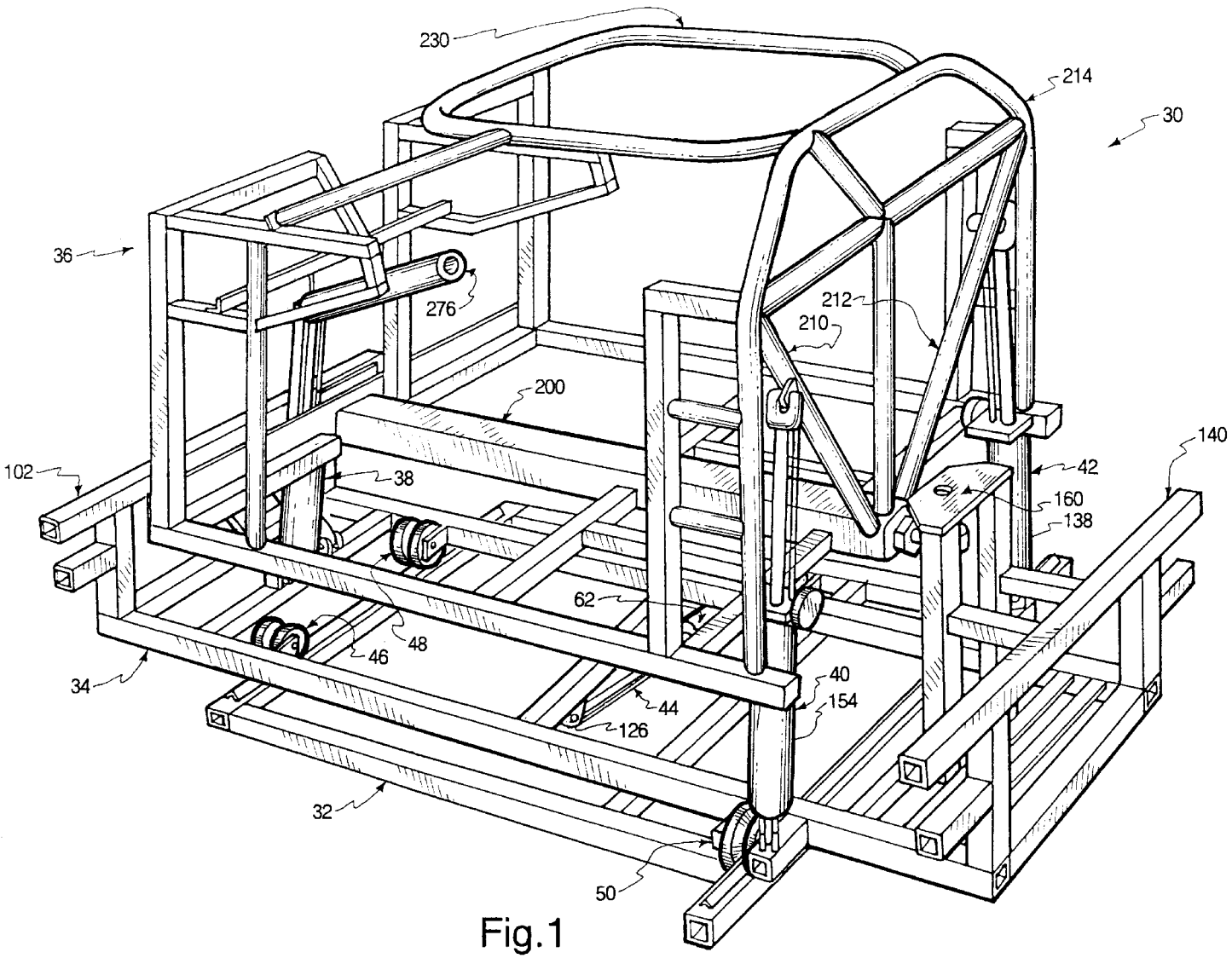
FIG. 1 is a perspective of a motion simulation apparatus according to the principles of the present invention.
Figure 2:
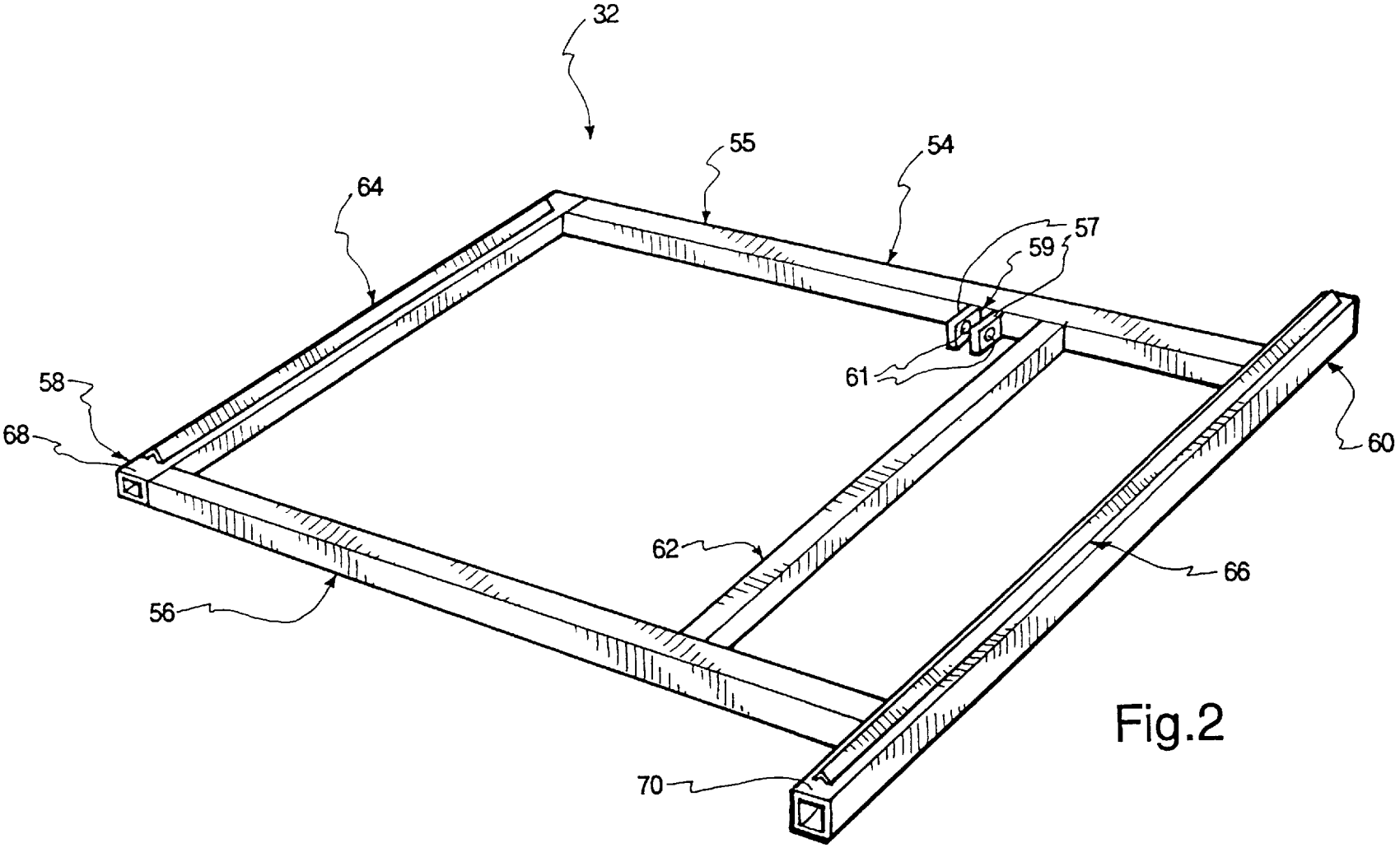
FIG. 2 is a perspective of the base of the motion simulation apparatus of FIG. 1.
Figure 3:
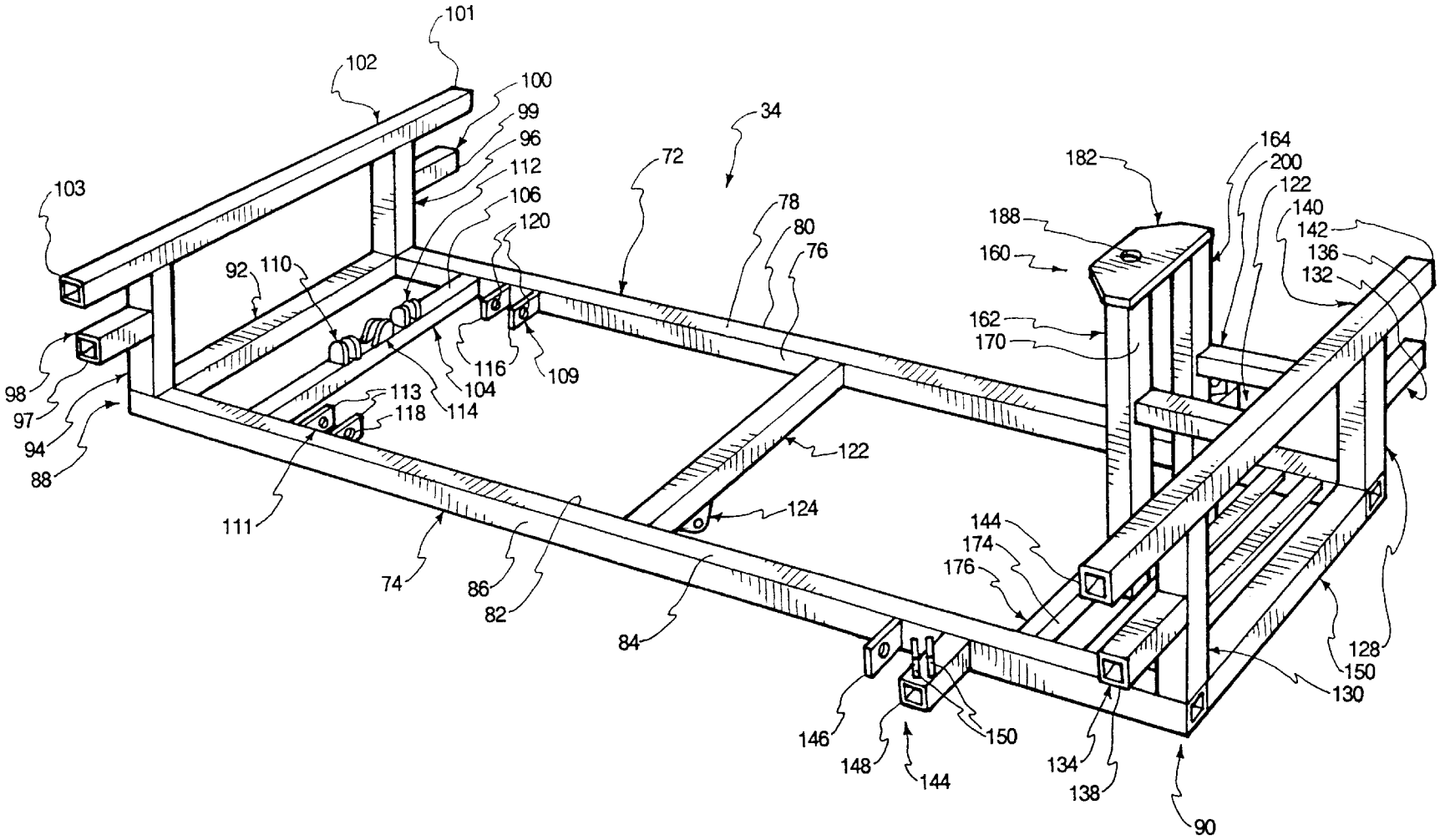
FIG. 3 is a perspective of the sled of the motion simulation apparatus of FIG. 1.
Figure 4:
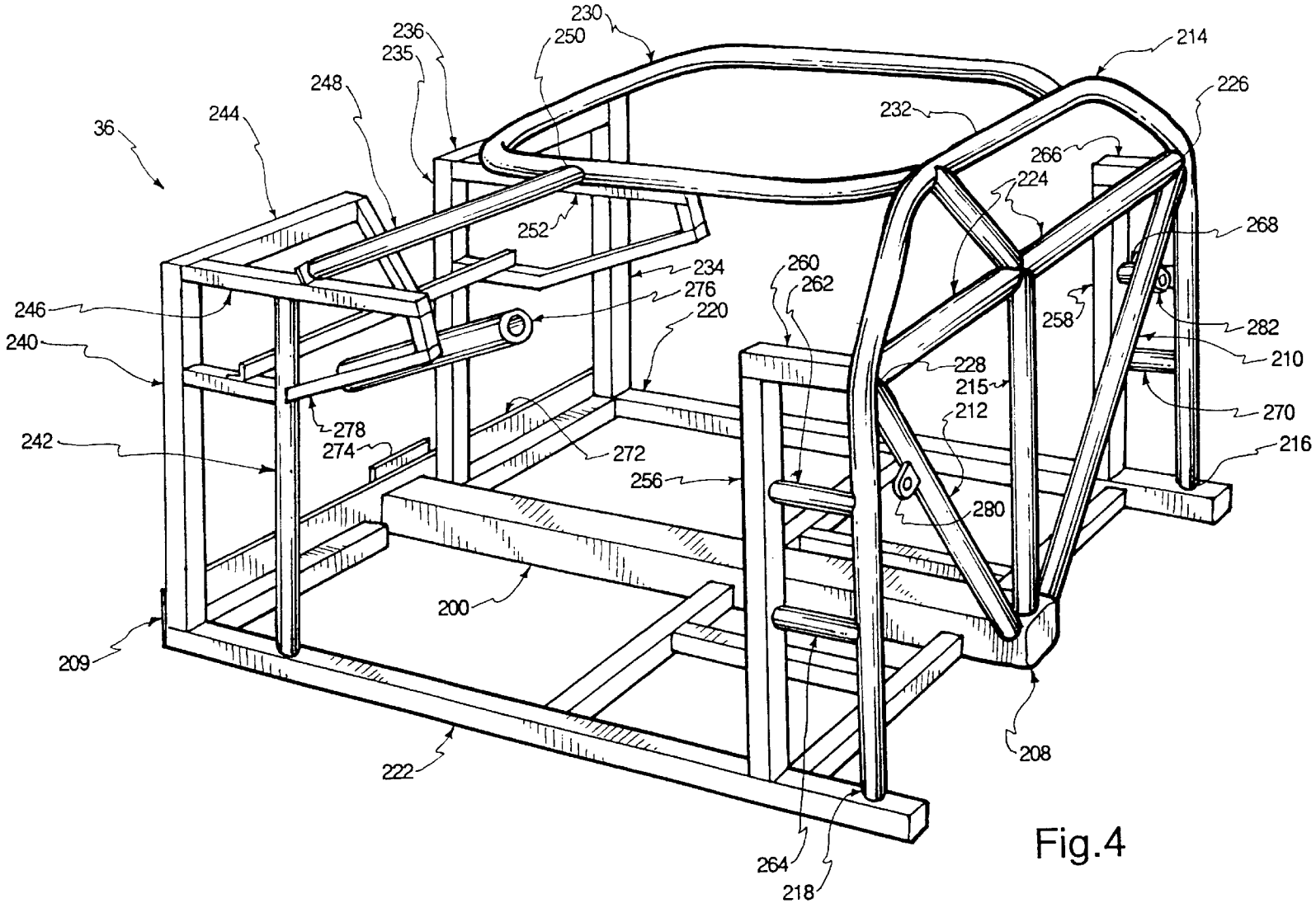
FIG. 4 is a perspective of the frame of the motion simulation apparatus of FIG. 1.
Figure 5:
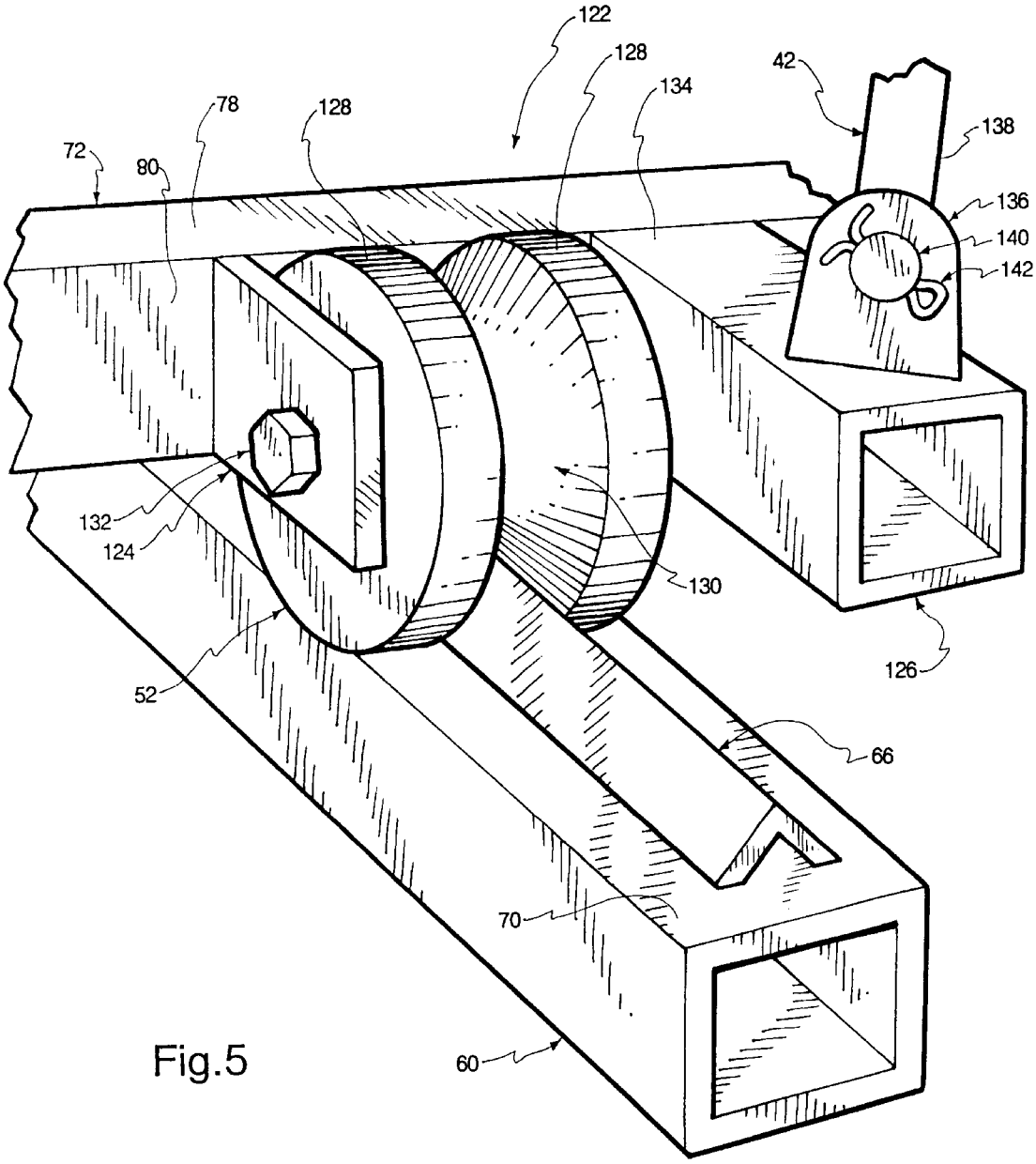
FIG. 5 is a close up perspective of the roller assembly of the motion simulation apparatus of FIG. 1.
Figure 6:
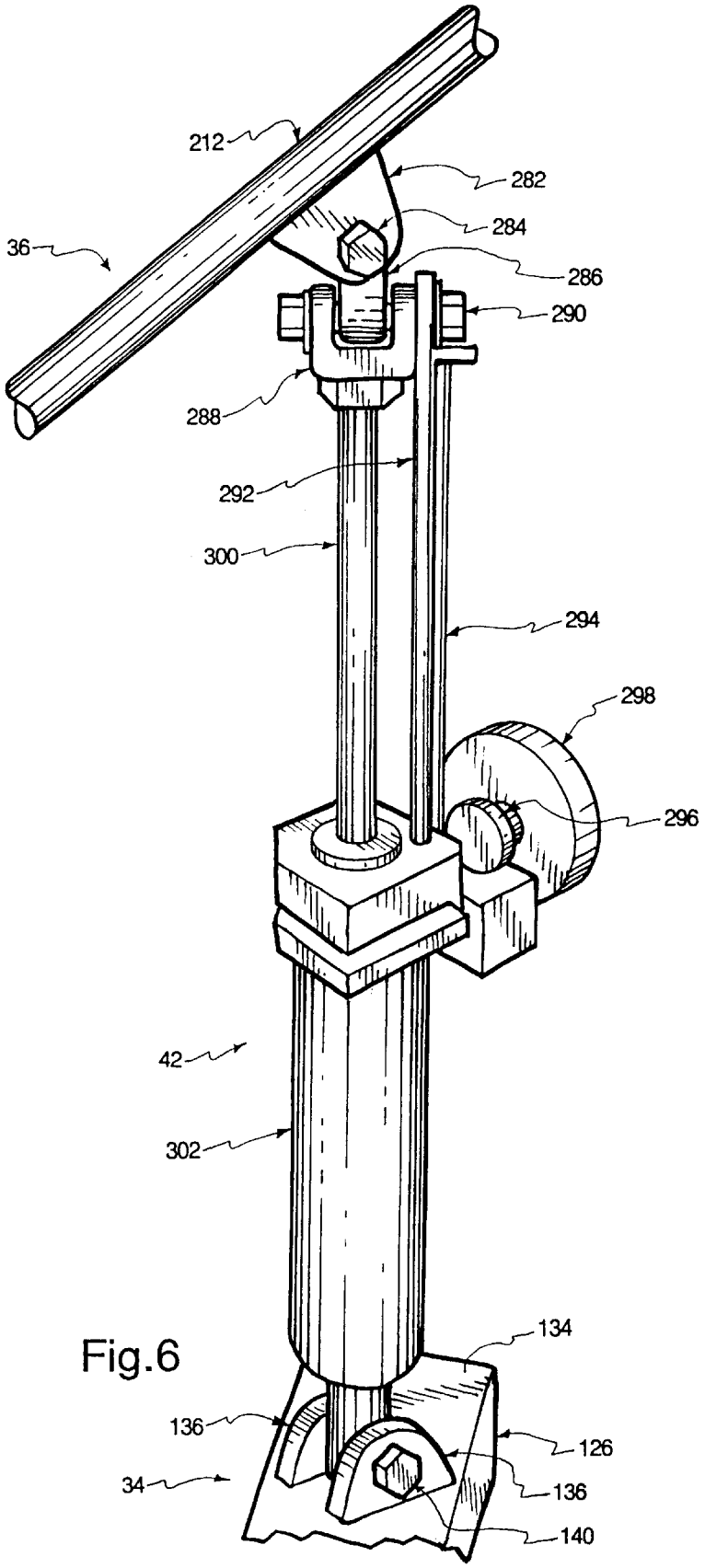
FIG. 6 is a close up perspective of a linear actuator of the motion simulation apparatus of FIG. 1.
Figure 7:
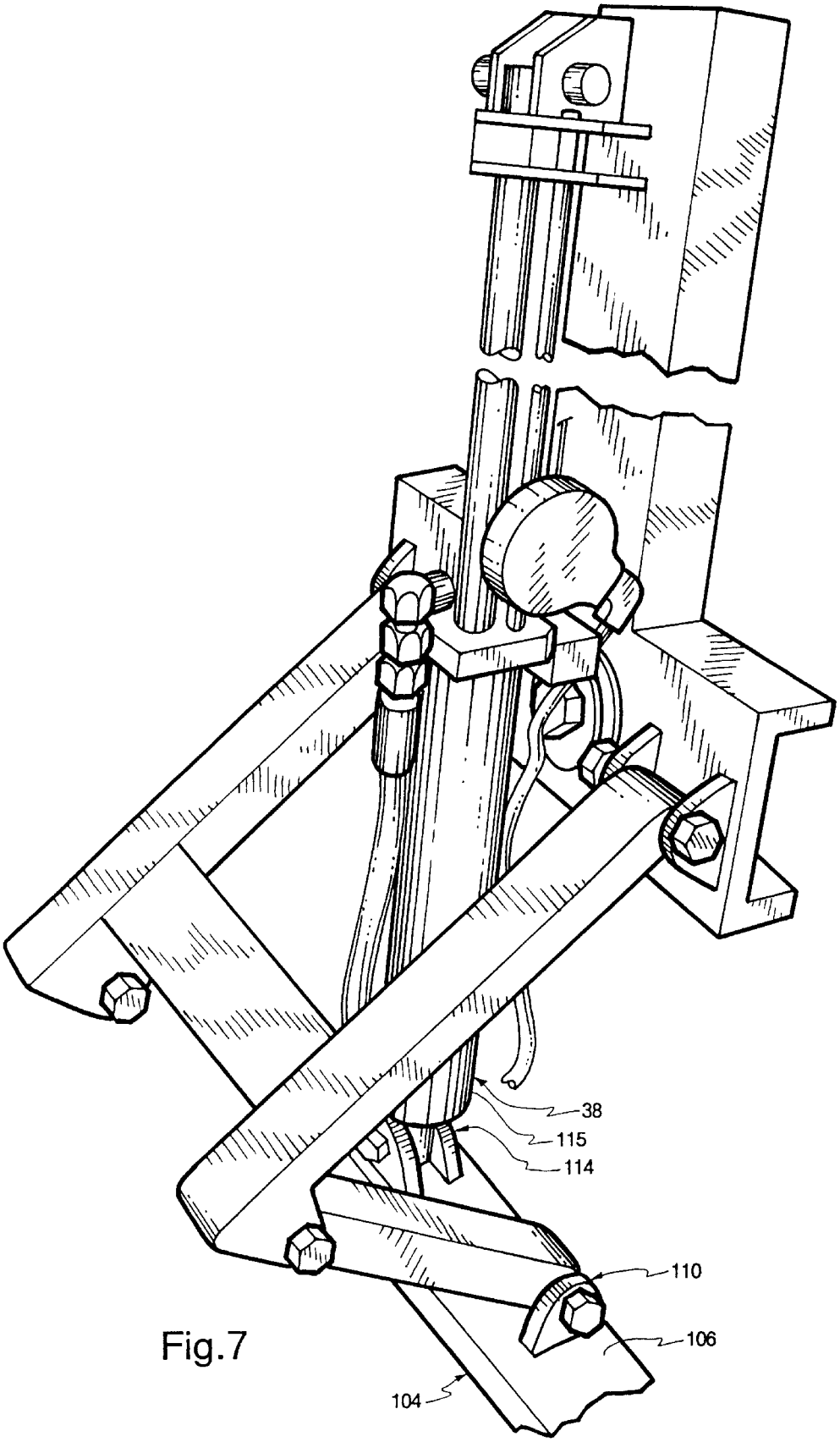
FIG. 7 is a close up perspective of the scissors assembly of the motion simulation apparatus of FIG. 1.
Figure 8:
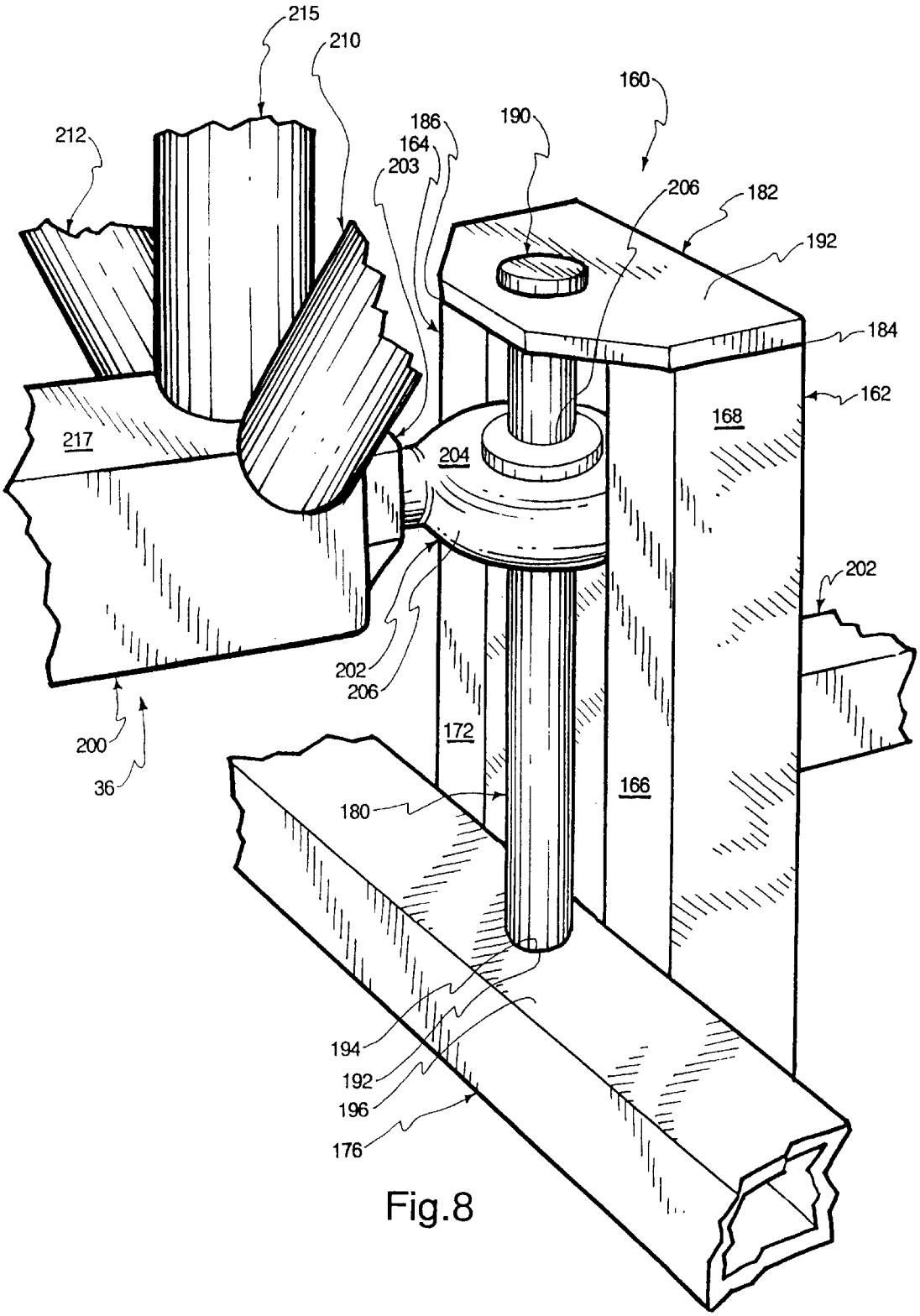
FIG. 8 is a close up perspective of the rear shaft collar bearing assembly of the motion simulation apparatus of FIG. 1.
Figure 9:
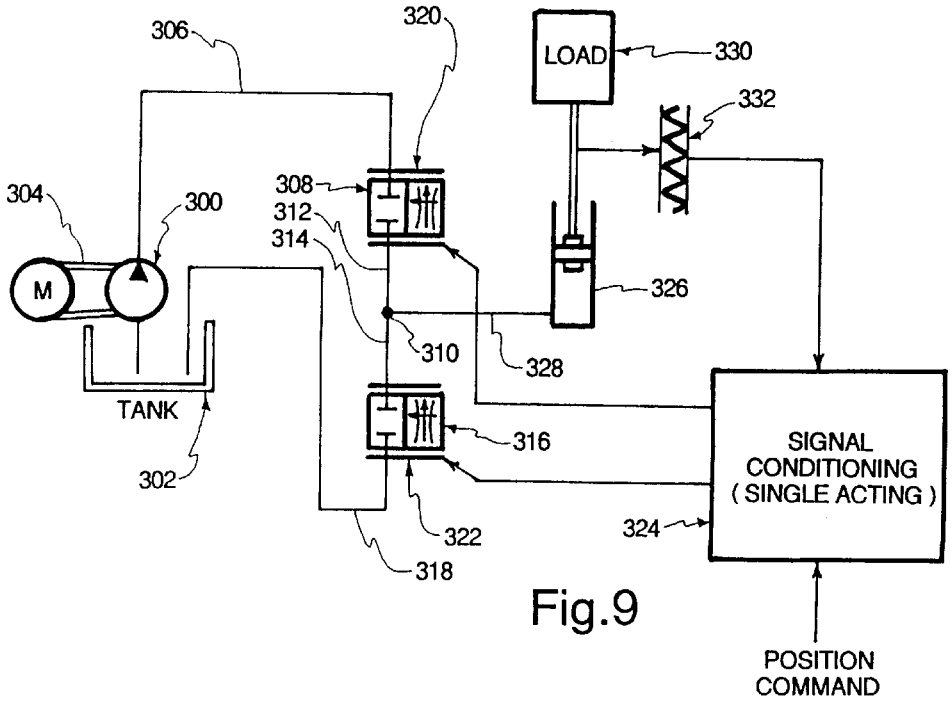
FIG. 9 is a schematic diagram of a single-acting actuator circuit of the motion simulation apparatus of FIG. 1.
Figure 10:
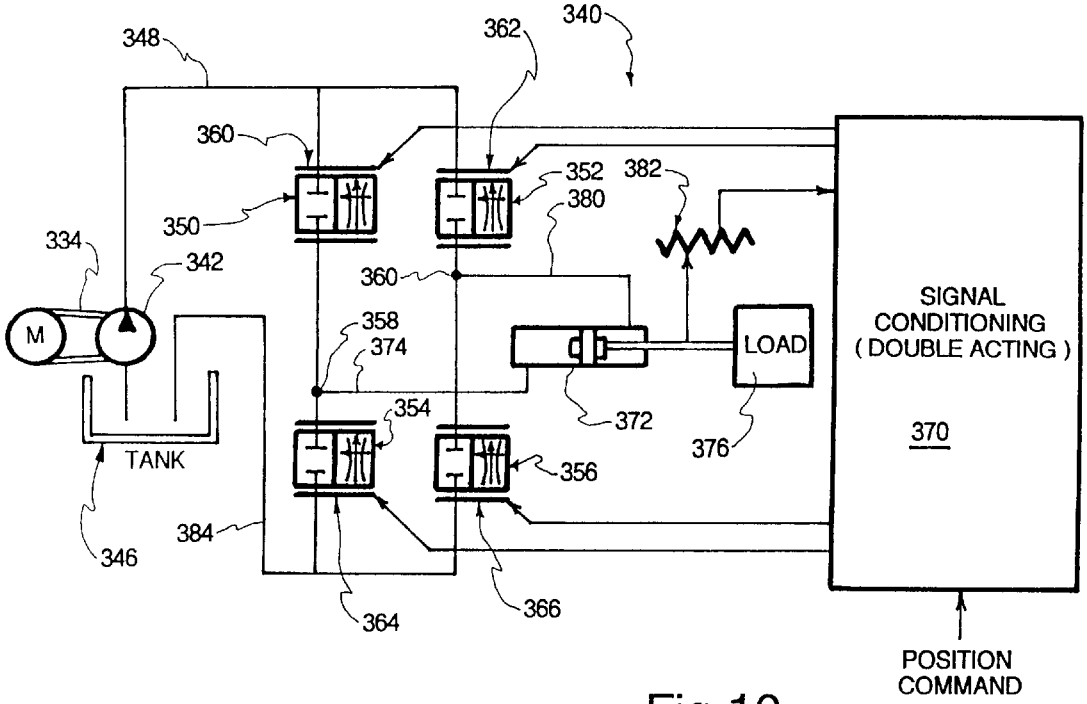
FIG. 10 is a schematic diagram of a double-acting actuator circuit of the motion simulation apparatus of FIG. 1.
Figure 15:
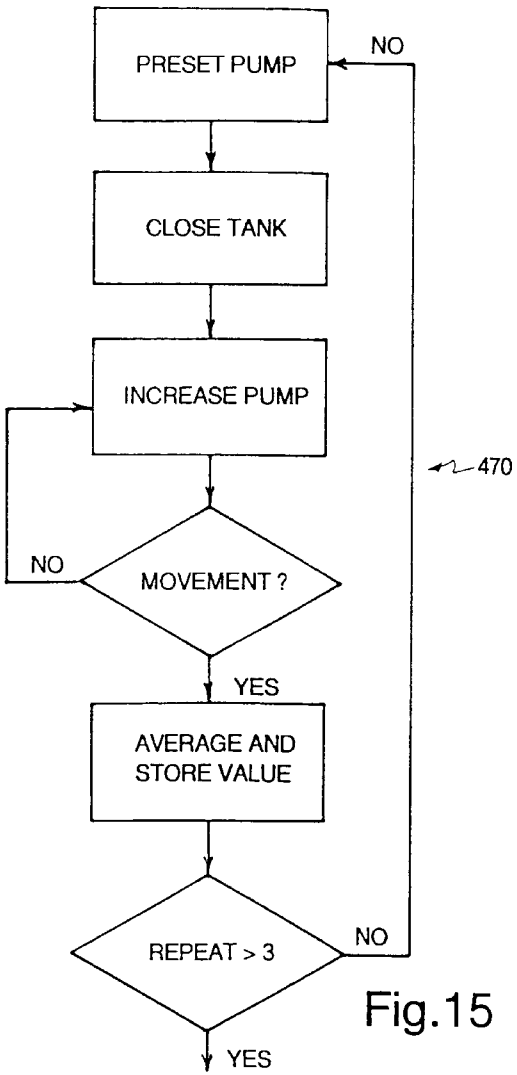
FIG. 15 is a flow chart diagram illustrating the calibration process of a pump valve of a single-acting actuator of the motion simulation apparatus of FIG. 1.
Figure 11:
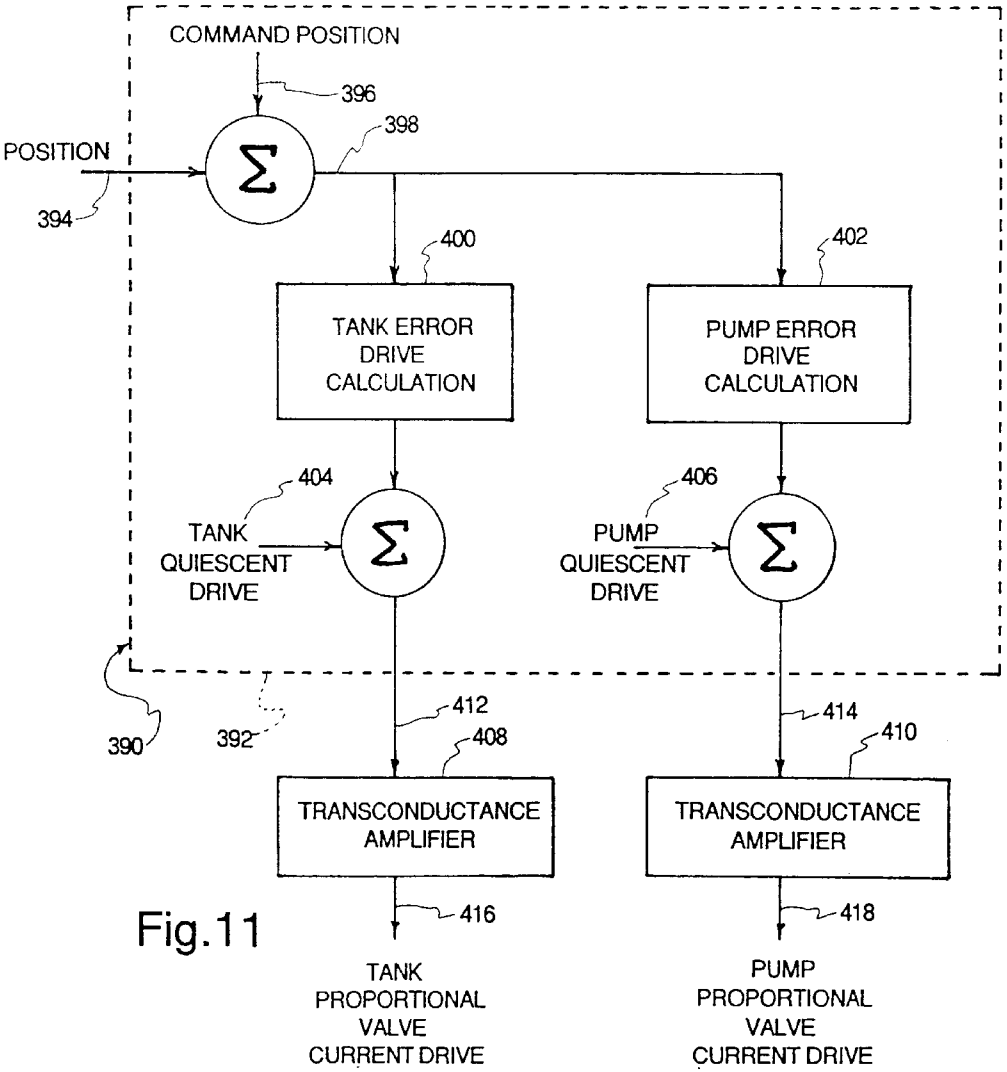
FIG. 11 is a schematic diagram of the signal conditioning process of the motion simulation apparatus of FIG. 1 for a single-acting actuation.
Figure 12:
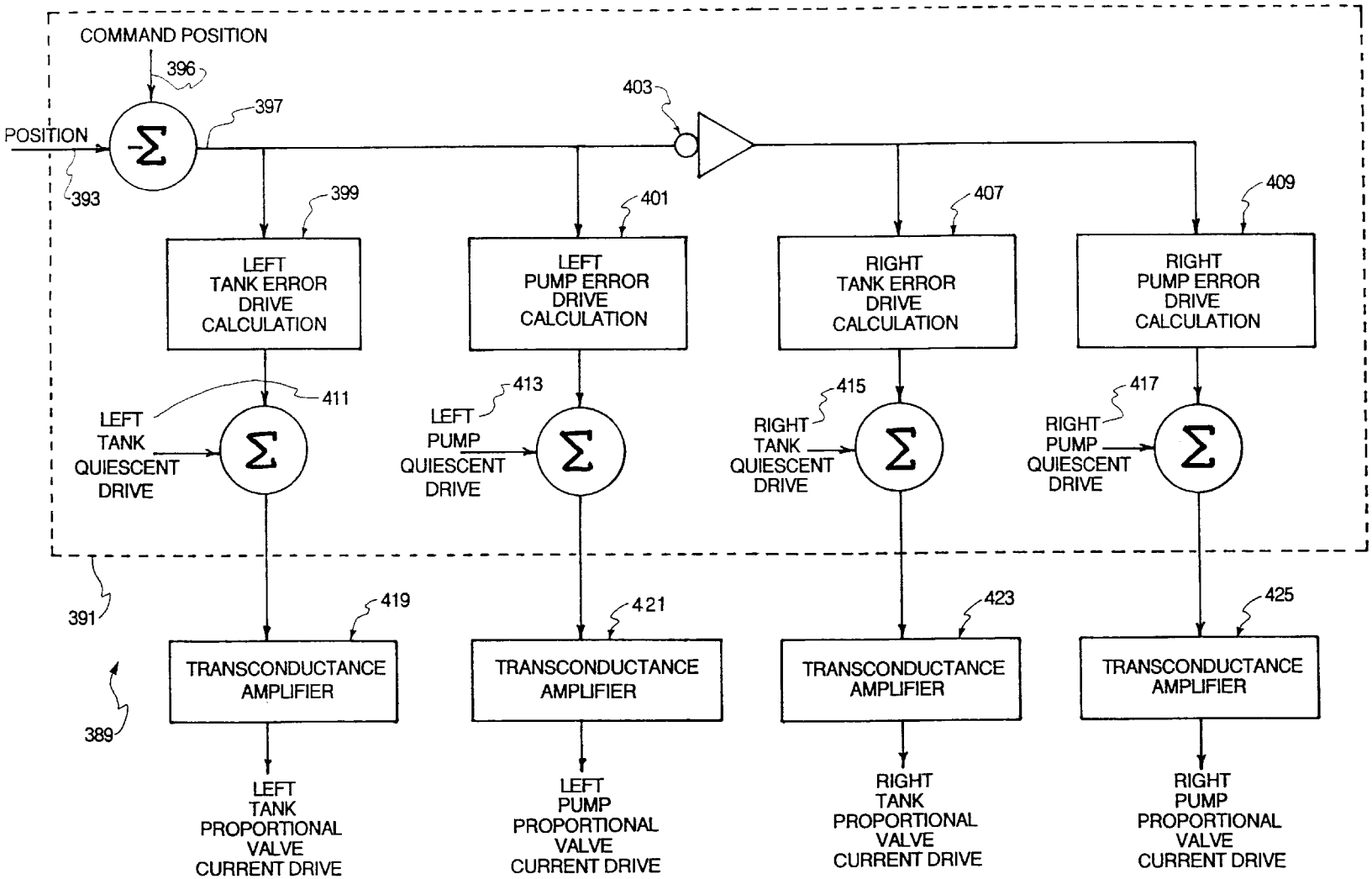
FIG. 12 is a schematic diagram of the signal conditioning process of the motion simulation apparatus of FIG. 1 for a single acting actuator.
Figure 13:
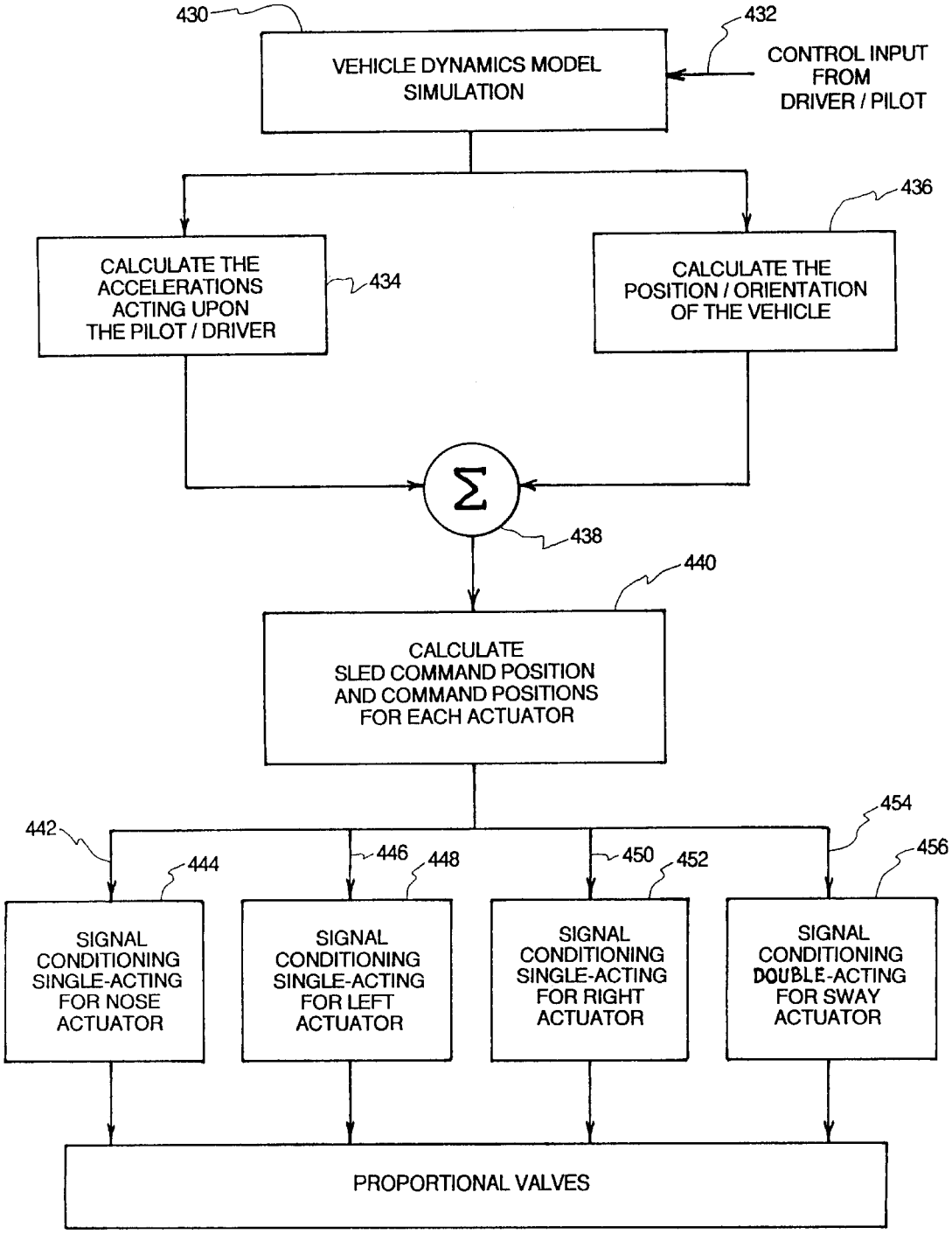
FIG. 13 is a schematic diagram of the control system of the motion simulation apparatus of FIG. 1.
Figure 14:
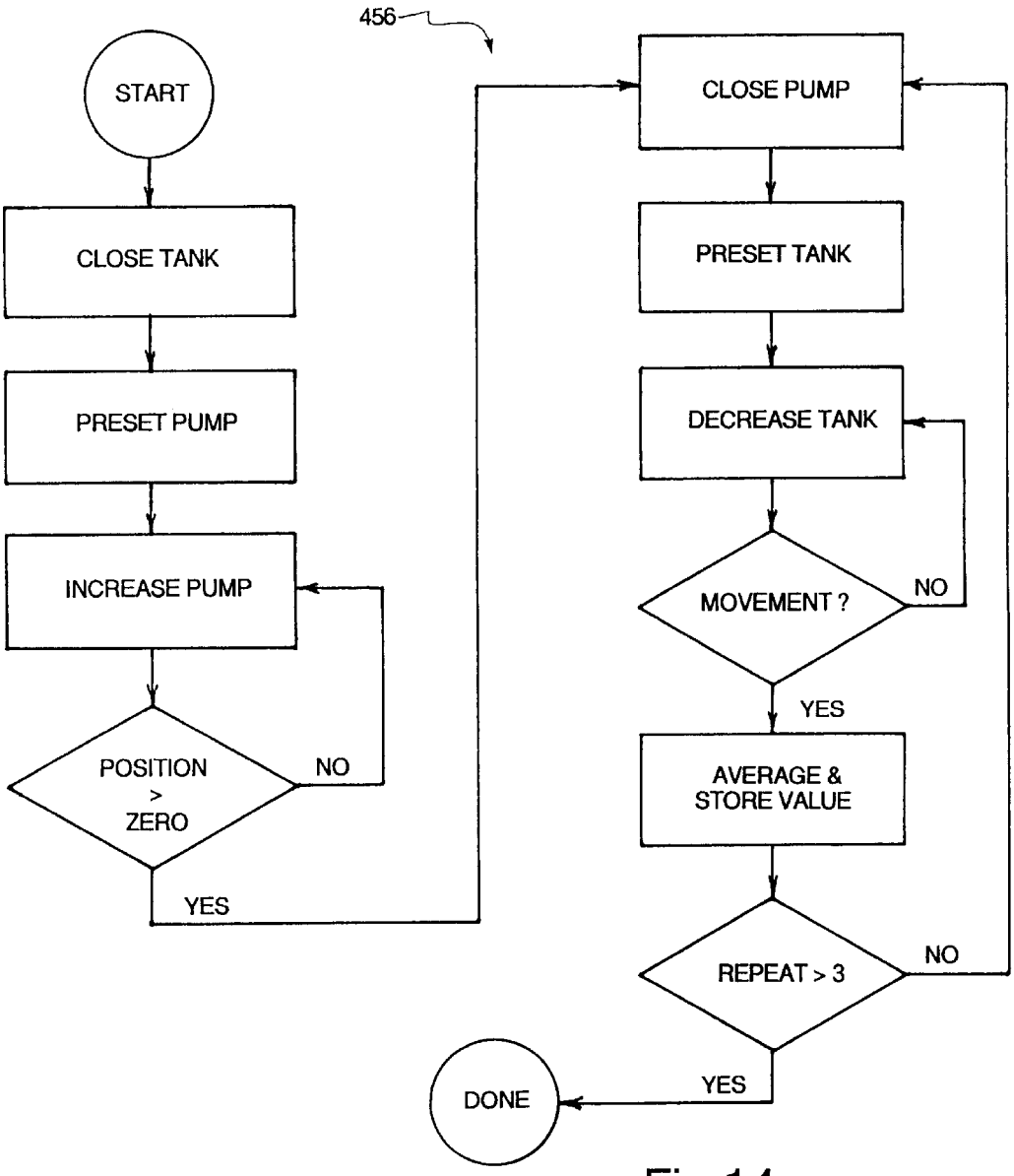
FIG. 14 is a flow chart diagram illustrating the calibration process of a tank valve of a single-acting actuator of the motion simulation apparatus of FIG. 1.
Figure 16:
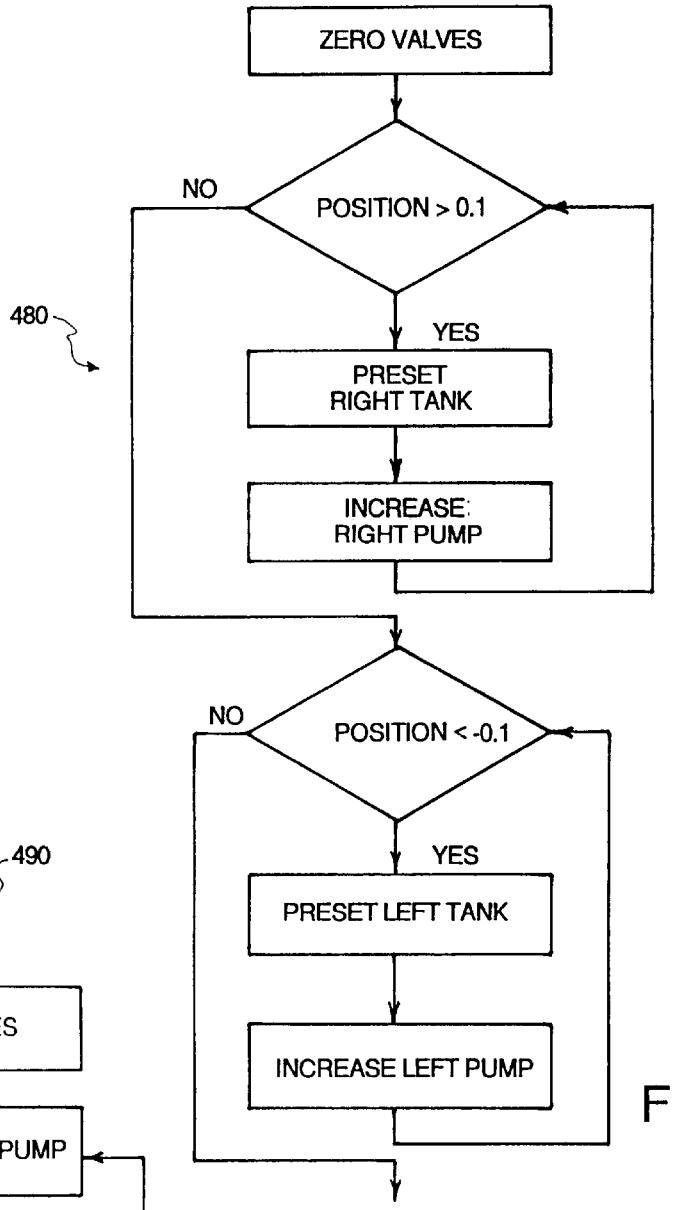
FIG. 16 is a flow chart diagram illustrating the centering process for a double-acting actuator of the motion simulation apparatus of FIG. 1.
Figure 17:
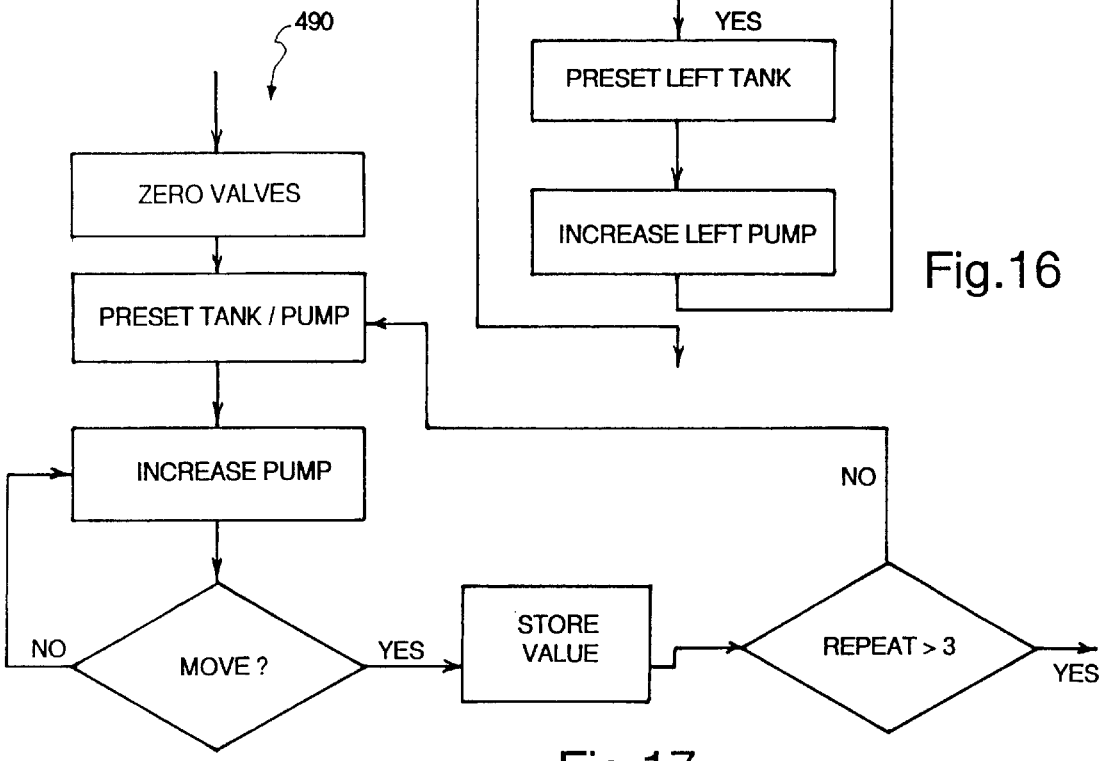
FIG. 17 is a flow chart diagram illustrating the calibration process for the pump valve of a double-acting actuator of the motion simulation apparatus of FIG. 1.
Figure 18:
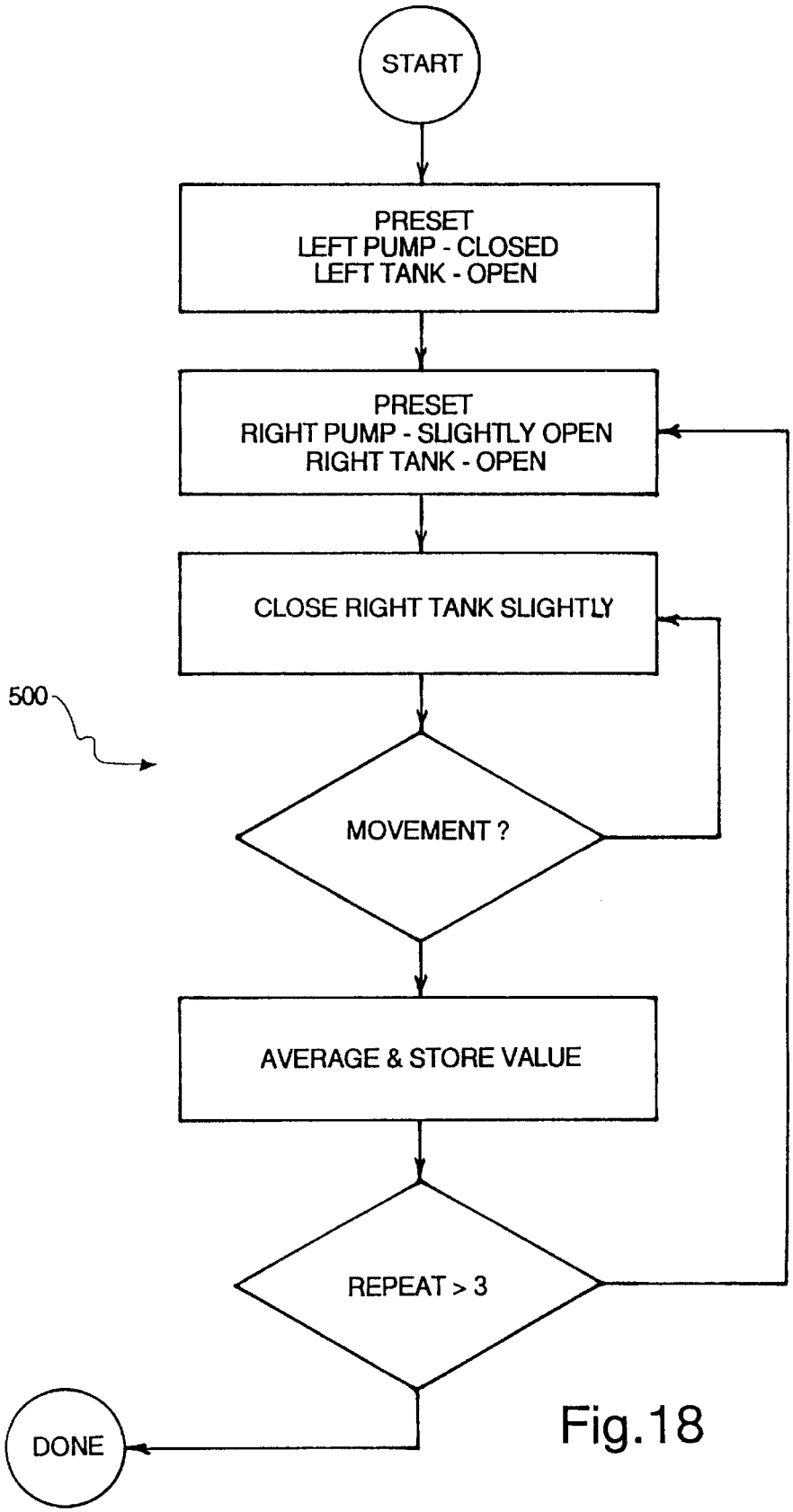
FIG. 18 is a flow chart diagram illustrating the calibration process for the tank valve of a double-acting actuator of the motion simulation apparatus of FIG. 1.
Figure 19:
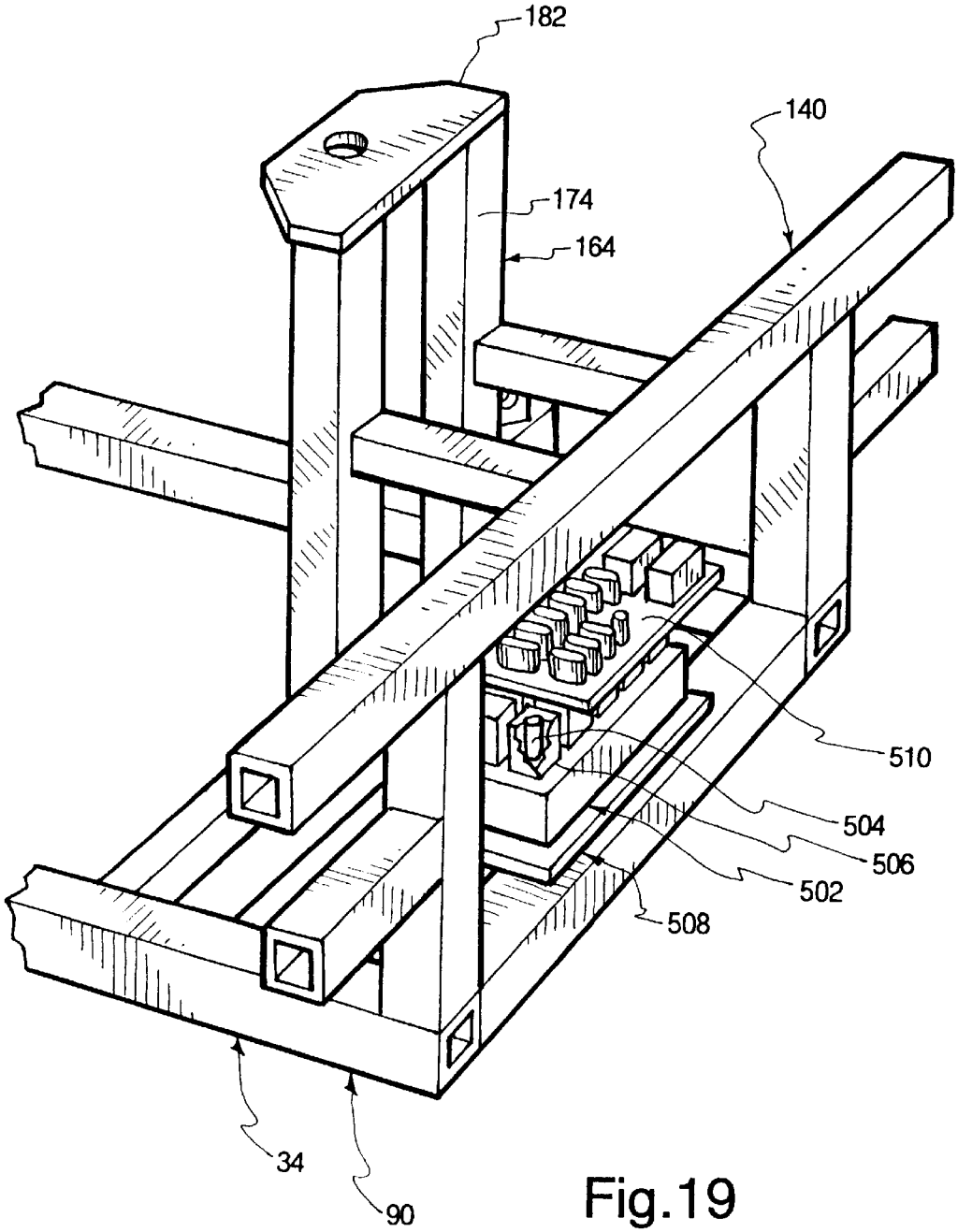
FIG. 19 is a perspective view of the back end of the sled of the motion simulation apparatus of FIG. 1.

Reference is now made to the drawings where like numerals are used to designate like parts throughout. FIG. 1 illustrates a motion simulation apparatus constructed according to the principles of the present invention. FIG. 2 illustrates the base of the motion simulation apparatus. FIG. 3 illustrates the sled of the motion simulation apparatus. FIG. 4 illustrates the frame of the motion simulation apparatus. FIG. 5 illustrates the roller assembly of the motion simulation apparatus. FIG. 6 illustrates a linear actuator of the motion simulation apparatus. FIG. 7 illustrates the scissors assembly of the motion simulation apparatus. FIG. 8 illustrates the rear shaft collar bearing assembly of the motion simulation apparatus. FIG. 9 illustrates the fluid circuit of a single-acting actuator of the motion simulation apparatus. FIG. 10 illustrates the fluid circuit of a double-acting actuator of the motion simulation apparatus. FIG. 11 illustrates the signal conditioning process of the motion simulation apparatus for a single-acting actuator. FIG. 12 illustrates the signal conditioning process for a double-acting actuator. FIG. 13 illustrates the control system for the motion simulation apparatus. FIG. 14 illustrates the calibration process for a tank valve of a single-acting actuator. FIG. 15 illustrates the calibration process for a pump valve of a single-acting actuator. FIG. 16 illustrates the centering process for a double-acting actuator of the motion simulation apparatus. FIG. 17 illustrates the calibration process for the pump valve of a double-acting actuator of the motion simulation apparatus. FIG. 18 illustrates the calibration process for the tank valve of a double-acting actuator of the motion simulation apparatus. FIG. 19 illustrates the back end of the motion simulation apparatus.

FIGS. 1 through 9 illustrate a motion simulation apparatus 30 according to the present invention. As shown, the motion simulation apparatus 30 generally comprises a base 32, a sled 34, a frame 36, a nose actuator 38, a left actuator 40, a right actuator 42, and a sway actuator 44. In general, the sled 34 is slidingly coupled with the base 32 by virtue of a rolling engagement of sled rollers 46, 48, 50, and 52 (FIG. 5) with the base 32. The frame 36 is vertically supported by the nose actuator 38, the left actuator 40, and the right actuator 42. Translation and rotation motion and reversal of translation and rotation motion is imparted to the frame 36 by the actuators 38, 40, 42, and 44.

FIG. 2 shows the base 32 of the motion simulation apparatus 30 as generally comprising two substantially parallel tubes 54 and 56, two transverse shafts 58 and 60, and a transverse support 62. The tubes 54 and 56 are shown as being perpendicularly secured to the transverse shafts 58 and 60. The tube 54 further comprises a sway actuator attachment 59 which, in turn, comprises two substantially parallel extension members 57 mounted on an inside surface 55 of the tube 54. The extension members 57 are shown as having apertures 61 formed therethrough for attaching a cylinder portion 62 (FIG. 1) of the sway actuator 44 to the extension members 57.

Additionally, raised tracks 64 and 66 are respectively formed on the top surfaces 68 and 70 of the transverse shafts 58 and 60. In one embodiment, the raised tracks 64 and 66 comprise elongated pieces of angle iron welded to the top surfaces 68 and 70. The purpose and function of the raised tracks 64 and 66 is discussed below.

FIG. 3 illustrates the sled 34 of the motion simulation apparatus 30 as generally comprising two substantially parallel beams 72 and 74 which extend from the sled front end 88 to the sled back end 90. The beam 72 further comprises an inside surface 76, a top surface 78, and an outside surface 80. Likewise, the beam 74 further comprises an inside surface 82, a top surface 84, and an outside surface 86.

A horizontal support 92 is secured between the beams 72 and 74 at the front end 88 of the sled 34. Moreover, posts 94 and 96 are perpendicularly mounded on the front end 88 of the beam top surfaces 78 and 84. The posts 94 and 96 support hollow horizontal arms 98 and 100, the horizontal arms 98 and 100 further comprising ends 97 and 99 respectively. A horizontal tube 102 having ends 101 and 103 is also shown as being horizontally mounted on the posts 94 and 96. Wheel hubs for wheels (not shown), may be inserted into the ends 97, 99, 101, or 103 depending on the desired height of the wheel relative to the sled 34. Generally, it is preferable to mount the wheel hubs in the ends 97 and 99 when transporting the sled 34 by rolling the sled 34 along the ground and to mount the wheel hubs in the ends 101 and 103 when the motion simulator apparatus 30 is in operation.

To provide support for a scissor assembly 104 (FIG. 7) and for the nose actuator 38 (FIG. 1), a platform 104 is horizontally interposed between the beams 72 and 74. As shown, the platform 104 has a top surface 106. A left scissor assembly attachment 110 and a right scissor assembly attachment 112 are mounted on the platform top surface 106. A nose actuator attachment 114 is also mounted on the top surface 106 and is positioned between the scissor assembly attachments 110 and 112. When the motion simulation apparatus 30 is fully assembled, a cylinder portion 115 of the nose actuator 38 is secured to the nose actuator attachment 114 as shown in FIG. 7.

Rollers 46, 48, 50 and 52 are rotatably mounted on the sled to permit the sled to selectively roll along the raised tracks 64 and 66 of the base 32 according to the degree of extension of the sway actuator 44. As illustrated in FIG. 3, roller sockets 111 and 109 are formed on the inside surfaces 82 and 76 of the beams 72 and 74. The roller socket 111 is shown as comprising two substantially parallel extension plates 113 perpendicularly mounted on the inside surface 82 of the beam 74. Likewise, the roller socket 109 comprises two substantially parallel plates 116. The extension plates 113 each further comprise an aperture 118 to permit the roller 46 to be rotatably connected to the extension plates 114. Similarly, the extension plates 116 further comprise apertures 120 for rotatably mounting the roller 48.

The rollers 50 and 52 are also mounted on the sled 34. The mounting configuration of roller 52 is illustrated in FIG. 5. As shown, a roller assembly 122 is shown as comprising an extension plate 124, and extension tube 126, and a roller 52. As shown, the roller 52 generally comprises two substantially cylindrical portion 128 and a tapered portion 130. A bolt 132 is illustrated as passing through the extension plate 124, the roller 52, and the tubular extension 126 to rotatably mount the roller 52 between the extension plate 124 and the tubular extension 126. As discussed above, the raised track 66 is rigidly affixed to the top surface 70 of the shaft 60. The raised track 66 is shown as being engaged with the tapered portion 130 of the roller 52 to cause a secure rolling relationship between the roller 52 and the top surface 70. The cylindrical portions 128 of the roller 52 rollingly contact the top surface 70 while the raised track 66 maintains the roller 52 substantially aligned on the shaft 60.

In addition to helping support the roller 52, the tubular extension 126 also serves to attach the right actuator 42 to the sled 34. Specifically, the tubular extension 126 is shown as comprising a hollow tube having a top surface 134 upon which an actuator flange 136 is securely mounted. As shown, a cylinder portion 138 of the right actuator 42 is securely mounted to the flange 136 by way of a shaft 140 and a pin 142. The roller 50 (FIG. 1) is secured to the sled 34 by a roller assembly 144 (FIG. 3) which is identical in all respects to the roller assembly 122 (FIG. 5) described above and comprises an extension plate 146 and a tubular extension 148. Actuator attachment flanges 150 are mounted perpendicularly on the tubular extension top surface 152. The flanges 150 collectively comprise a mounting location for a cylinder portion 154 of the left actuator 40 (FIG. 1).

The sled 34 further comprises a transverse support 122 secured between the beams 72 and 74. A sway actuator rod attachment flange 124 is attached to a bottom surface of the support 122 for connecting the rod 126 of the sway actuator 44 to the sled as illustrated in FIG. 1.

Posts 128 and 130 are mounted on the beam top surfaces 78 and 84 respectively at a back end 90 of the sled 34. Horizontal extension tubes 132 and 134 having ends 136 and 138 respectively for receiving wheel hubs (not shown) are mounted on the posts 128 and 130 respectively. An elongated tube 140, comprising ends 142 and 144, is also mounted on the posts 128 and 130. The tube ends 136, 138, 142, and 144 are configured to selectively receive wheel hubs (not shown). A transverse end member 150 is also secured between the beam inside surfaces 76 and 82 at the sled back end 90 to provide additional stability to the sled 34.

FIGS. 1, 3, and 8 illustrate a ground shaft capture assembly 160 which generally comprises two substantially parallel columns 162 and 164. Column 162 comprises a front surface 166 and an outside surface 168. Likewise, the column 164 comprises a front surface 172. The front surfaces 166 and 172 of the columns 162 and 164 are rigidly attached to a rear surface 174 of a ground shaft horizontal support 176. The ground shaft horizontal support is rigidly attached to the inside surface 76 of beam 72 and the inside surface 82 of the beam 74.

A ground shaft 180 is illustrated in FIG. 8 as being securely positioned within a horizontal ground plate 182. The ground plate 182 is rigidly connected to the top end 184 of the column 162 and to the top end 186 of the column 164. Further, the ground plate 182 has an aperture 188 (FIG. 3) sized to tightly receive the ground shaft 180 therethrough. The ground shaft 180 further comprises a knob 190 which is securely positioned adjacent to the top surface 192 of the ground plate 182. Additionally, the bottom end 192 of the ground shaft 180 is secured within an aperture 194 formed in the top surface 196 of the ground shaft horizontal support 176.

The ground shaft capture assembly 160 is further supported by arms 200 and 202. The arms 200 and 202, as shown, are interposed between the rear surfaces 170 and 174 of columns 162 and 164 and the front surface of the horizontal shaft 140.

A main member 200 of the frame 36 is rotatably coupled with a cylindrical collar 202 by a collar bearing 203. The cylindrical collar 202 comprises a top surface 204 and a cylindrical side surface 206. The ground shaft 180 is positioned within an aperture 206 formed through the collar 202 to permit the collar 202 to slide longitudinally up and down the ground shaft 180 relative to the sled 34. The collar 202 is also coupled with the frame main body member 200 via a bearing 203 so that the frame 36 may rotate relative to the sled 34, may move vertically relative to the sled 34, but may not move laterally with respect to the sled 34. Thus, the ground shaft 180 prevents lateral movement between the frame 36 and the sled 34 while permitting the frame to move vertically with respect to the sled 34.

The frame 36 is illustrated in FIGS. 1, 4, and 8. The frame main body member 200 extends the entire length of the frame 36. At the rear end of the frame main body member 200, diagonal members 210 and 212 are illustrated as being positioned between the main body member 200 and an inverted U-shaped member 214. The ends 216 and 218 of the inverted U-shaped member 214 are rigidly attached to frame side beams 220 and 222 respectively. A horizontal member 224 is attached to the diagonal members 210 and 212 at 226 and 228 respectively. Thus, the horizontal member 224, the diagonal member 210, and the diagonal member 212 form an inverted triangle within the inverted U-shaped member 214. A vertical member 215 is mounted vertically on the top surface 217 of the main body member 200.

A rounded top member 230 is horizontally oriented and supported by the inverted U-shaped member 214 along edge 232 and vertically supported by a post 234. The post 234 is attached to and extends vertically from the beam 220. The post 234 is positioned in parallel relationship with post 235, the posts 234 and 235 support, a horizontal member 236.

Additionally, comer post 240 is mounted on the beam 222 and extends vertically from that beam. A second beam 242 is also mounted on the beam 222 and extends vertically from the beam 222. Top horizontal members 244 and 246 are perpendicularly oriented relative to one another and are supported by the posts 240 and 242. A cross member 248 extends from the horizontal member 246 and connects with the top member 230 at 250. To further support the top member 230, an additional horizontal extension 252 extends rearwardly from the vertical post 235.

To provide additional support to the inverted U-shaped member 214, vertical posts 256 and 258 are securely mounted on the beams 222 and 220 respectively. The post 256 provides support to the inverted U-shaped member 214 through arms 260, 262, and 264. Similarly, the post 258 provides support to the inverted U-shaped member 214 via arms 266, 268, and 270. At the front end 209 of the frame 36, an elongated plate 272 is securely fastened to the posts 240, 235, and 234. A smaller plate, 274 is attached to the front side of the plate 272. Lastly, a steering column 276 is rigidly attached to an arm 278 extending from the post 242 to permit the installation of a steering wheel in the frame 236.

It must be noted that a left cylinder attachment flange 280 is attached to the diagonal member 212 and, likewise, a right actuator attachment flange 282 is rigidly attached to the diagonal member 210. Accordingly, the frame 36 is supported vertically, at its back end 208 by the left and right actuator 40 and 42 respectively, which are connected at attachments 280 and 282.

FIG. 6 illustrates the right cylinder 42 interconnecting the frame 36 with the sled 34. The diagonal member 212 is shown as having formed thereon the cylinder attachment flange 282. A bolt 284 secures a block 286 to the attachment flange 282. A yoke 288 is coupled to the block 286 via a second bolt 290. In addition to coupling the yoke 288 to the block 286, the second bolt 290 also secures an encoder rod 292 to the yoke 288. The string 294 is coupled with a pulley 296 which is, in turn, coupled with a rotary encoder 298. While a number of devices may be effective in measuring and monitoring the degree to which the piston rod 299 is extended from the cylinder portion 301, a US DIGITAL brand encoder having part number #S2-1024-IB has been found to function satisfactorily.

A string 294, which preferably comprises a polyethylene coated multi-wire cable is wrapped around the pulley 296. Thus, as the piston rod 299 moves up and down relative to the cylinder 301, the pulley 296 turns proportionally. That is, as the piston rod 299 moves up and down, the string 294, in equal amounts, also moves up and down and causes the rotation of the rotary encoder 298. The rotary encoder 298 output then becomes the input to a signal conditioner, discussed below.

Accordingly, in the configuration illustrated in FIG. 1, the frame may be caused to tilt from one side to the other by raising or lowering the left actuator 40 more than the right actuator 42. Additionally, the frame can be made to tilt forward and backward by moving the nose actuator 38 higher or lower than the actuators 40 and 42. Further, horizontal translational movement can be imparted to the frame by changing the degree of extension or retraction of the piston cylinder rod 126 of the sway actuator 44.

Each actuator is driven by a fluid circuit. As shown in FIG. 9, the fluid circuit for a single-acting actuator is illustrated. In the embodiment of FIG. 1, single-acting actuators are advantageously used for the nose actuator 38, the left actuator 40, and the right actuator 42 because gravity forces cause the respective piston rods to be retracted into the cylinders as the fluid pressure is released.

It must also be pointed out that as used in this document, the term "fluid" encompasses "air," "hydraulic fluid," and any other working fluid.

Turning now to FIG. 9, a motor M is illustrated as driving a pump 300 which pumps fluid out of a tank 302. Rotational power is transferred from the motor M to the pump 300 via a rotational power transfer apparatus such as a belt 304. The pump 300 pumps pressurized fluid through the line 306 into a pump proportional valve 308. It has been found that a conventional "WATERMAN" proportional valve sold under part no. 12C21SP11 manufactured by Waterman Hydraulics, 6565 West Howard Street, Niles, Ill. may be used satisfactorily.

The pump valve 308 is advantageously a normally-closed valve so that fluid pressure, such as hydraulic fluid pressure, is closed off when the power to the motor M goes off. Fluid and fluid pressure then passes from the valve 308 to a series connection 310 along conduit 312. Then, depending on the system pressures, fluid passes from the series connection along conduit 314 into a tank proportional valve 316. The tank proportional valve preferably comprises a normally-open proportional valve and may satisfactorily comprise a "WATERMAN" tank valve sold by Waterman Hydraulics under part no. 12C25SP-11. Then, the fluid may return to the tank 302 through conduit 318. The proportional valves 308 and 316 are driven by solenoids 320 and 322 respectively. The solenoids, in turn, are driven by the signal conditioning unit. The purpose and function of the signal conditioning unit 324 is discussed below.

Accordingly, by selectively changing the size of the orifices in the valves 308 and 316, the fluid flow and pressure transmitted to the linear actuator 326 through a conduit 328 may be selectively and smoothly varied. As such, transitional motion may be smoothly imparted to a load 330 by smoothly and selectively changing the pressure transmitted to the linear actuator 326. It has been found that the linear actuator 326 may satisfactorily comprise an ATLAS hydraulic cylinder 1.54 FAUVE sold under manufacturing part no. LD15-PB 2-0062-1-NC 1 for many applications, such as in connection with the motion simulation apparatus 30. It should also be noted that the load 330 may advantageously comprise motion simulation equipment generally, and specifically, may comprise the frame 36 described in connection with FIGS. 1 and 4.

A linear actuator position sensor 332, such as the encoder rod 292/string 294 assembly used in connection with an encoder 298 may be effectively used to determine the position of the linear actuator 326. To appropriately drive the valves 308 and 316, the position sensing device 332 transmits linear actuator position information to the signal conditioning device 324. The signal conditioning device 324 is discussed in more detail below in connection with FIG. 11.

FIG. 10 illustrates a flow circuit and control information circuit 340 for a double-acting cylinder 374. In the embodiment illustrated in FIG. 1, a double-acting linear actuator may be advantageously employed as the sway actuator 44. This is because once extended, the sway actuator normally does not have the benefit of gravity forces to naturally cause the piston rod to be retracted into the cylinder as the pressure transmitted to the sway actuator 44 is reduced. Instead, a double-acting linear actuator is preferably used to drive the sway actuator 44 in both directions.

Accordingly, as illustrated in FIG. 10, the circuit 340 comprises a motor M coupled to a pump 342 via a power transfer device such as a flexible belt 334. The pump 342 is shown as being coupled with a fluid tank 346 and the pump pumps fluid from the fluid tank 346 through conduit 348 into a left pump proportional valve 350 and into a right proportional pump valve 352. From there, the fluid passes to a left proportional tank valve 354 and into a right proportional tank valve 356. As shown, the left valves 350 and 354 are connected in series at a first series connection 358 and the right valves 352 and 356 are series connected at a second series connection 360.

In a manner identical to that with FIG. 9, the valves 350, 352, 354, and 356 are driven by solenoids. The pump valves 350 and 352 are respectively driven by solenoids 360 and 362. Likewise, valves 354 and 356 are driven by solenoids 364 and 366 respectively. The solenoids 360, 362, 364, and 366, as shown, are, in turn, driven by the signal conditioning device 370. The signal conditioning device 370 is discussed below.

A double-acting linear actuator 372 is coupled with the first series connection 358 via a conduit 374 for moving the load 376 in a first direction and the second series connection 360 is coupled to the double-acting linear actuator 372 by conduit 380 to drive the load 376 in a second direction.

Thus, the left valves 350 and 354 drive the actuator in one direction and the right valves 352 and 356 drive the actuator in the opposite direction. To monitor the position of the linear actuator, a position sensing device 382 is coupled with the linear actuator 372. The position sensing device 382 is identical in all respects with the position sensing device 332 described above in connection with FIG. 9. The position sensing device 382 is coupled with the signal conditioning device 370 for purposes that will be discussed in more detail below. Lastly, fluid is returned to the tank 346 through conduit 384 which is coupled with the tank valves 354 and 356.

FIG. 11 illustrates the signal conditioning process 390 of the signal conditioning device 324 of FIG. 9. The signal conditioning device 324 preferably comprises a program data processor. The features illustrated within the dotted box 392 of FIG. 11 illustrate tasks accomplished by software operation. Features outside of the dotted box 392 are performed in hardware operations. As inputs to the signal conditioning process 390, the position 394 of a given linear actuator is input into the process from a position sensing device such as position sensing device 332 illustrated in FIG. 9. Additionally, a command position 396 is also input into the process from a controlling computer which indicates a desired position for the linear actuator.

Then, the command position 396 and the actual position 394 are compared and the difference between those two positions is taken and comprises an error signal 398. The error signal 398 represents the difference between the actual position of the linear actuator 326 and the desired position. Then, the error signal 398 is transmitted to a tank valve calculation operation 400 which is typically a multiplication of scaling but could be any function to provide desirable valve operation and a pump valve calculation operation 402. Because the tank valve and the pump valve for each linear actuator are controlled by the amount of current flowing through the associated solenoid, the tank calculation operation 400 and the pump calculation operation 402 determine whether more or less current needs to be sent to each solenoid to cause the valve to open or close.

Generally, there are slight variations from valve to valve in the amount of current that needs to be passed through the associated solenoid to open or close the valve. For example, some valves may require 1.2 amps and others may require only 0.95 amps. Further, these current amounts may change over time as the valves wear. Thus, there is a need to condition the error calculation for a given valve according to the amount of current the valve requires to open or close.

Accordingly, the tank error drive calculation is transmitted to a tank quiescent drive 404 which applies an offset to the tank error drive calculation at the summing junction according to the particular tank valve being currently used. Similarly, the pump error drive calculation is transmitted to a pump quiescent drive 406 which, applies an offset to the pump error drive calculation at the summing junction according to the particular pump valve being used.

The outputs 412 and 424 of the tank quiescent drive 404 and the pump quiescent 406 are respectively transmitted out of a program data processor to transconductance amplifiers 408 and 410. The transconductance amplifiers 408 and 410 convert the voltage outputs 412 and 414 from the quiescent drives respectively into current outputs 416 and 418. The current output 416 of the transconductance amplifier 408 is then sent to the solenoid associated with the tank valve to selectively open the tank valve the necessary amount. Likewise, the current output 418 of the transconductance amplifier 410 is sent to the solenoid associated with the pump valve to selectively cause the pump valve to open or close a desired amount. The current output from the transconductance amplifiers 408 and 410 is generally directly proportional to the input voltages 412 and 414.

FIG. 12 is a schematic diagram of the signal conditioning device 370 illustrated in FIG. 10. The signal conditioning device 370 preferably comprises a program data processor. The features illustrated within the dotted box 391 illustrate tasks accomplished by software operation. Features outside of the dotted box 391 are performed in hardware operations. As inputs to the signal conditioning process 389, the position 393 of a given linear actuator is input into the process from a position sensing device such as position sensing device 382 illustrated in FIG. 10. Additionally, a command position 396 is also input into the process from a controlling computer which indicates a desired position for the linear actuator.

Then, the command position 396 and the actual position 393 are compared and the difference between those two positions is taken and comprises an error signal 397. The error signal 397 represents the difference between the actual position of the double-acting linear actuator 372 and the desired position. Then, the error signal 397 is transmitted to a left tank valve calculation unit 399 and a left pump valve calculation 401, and to an inverter 403.

The inverted error signal 405 is then transmitted to a right tank error calculation circuit 407 and to a right pump error calculation circuit 409. The error signals sent to the left and right valves, are inverted because the left and right valves optimally function exactly opposite from one another.

The quiescent drives 411, 413, 415, and 417 serve the same purpose and function identically as the quiescent drives 404 and 406 described above in connection with FIG. 11. Likewise, the transconductance amplifiers 419, 421, 423, and 425 also function the same way and as for the same purposes as the transconductance amplifiers 408 and 410 described above in connection with FIG. 11.

FIG. 13 illustrates the top level operation of the motion simulation apparatus 30. A vehicle dynamics model simulation 430 is performed within a programmed data processor which receives control input from the driver/pilot of the motion simulator apparatus 30. This control input comes from the simulator controls, such as the steering wheel, throttle, brake, gear shifter, etc. Based on the control input 432, the vehicle dynamics model simulator calculates the accelerations 434 acting upon the simulator operator and calculates the position/orientation 436 of the frame 36. Based on the summations 438 of the accelerations acting upon the operator and the position 436 of the vehicle, the sled command positions and command positions for each actuator are then calculated 440. The calculated command position for the single-acting nose actuator 442 is sent to the signal conditioning device 444 for the single-acting nose actuator. Likewise, the command position for the left actuator 446 is sent to the signal conditioner for the left actuator. The command position for the right actuator 450 is sent to the signal conditioner for the right actuator 452. Lastly, the command position for the double-acting sway actuator 454 is then transmitted to the signal conditioner for the double-acting sway actuator 456.

Then, as illustrated in FIGS. 11 and 12, the various signal conditioning devices drive the various proportional valves to control the position and accelerations of the sled 36.

FIG. 14 illustrates, in a flow chart format, the auto calibration process 456 for the tank valve 316 of FIG. 9. The first step is to close the tank valve. Because the tank valve 316 is a normally-open valve, the tank valve 316 must be closed. Next, the pump valve is preset by sending a certain amount of current, such as 0.3 amps, to the solenoid 320. Then, the current sent to the pump valve is slowly increased. After each incremental increase of the current to the pump valve 316, the position of the linear actuator 326 is measured to determine if the linear actuator is above its centered or zero position. If the linear actuator is not above its central or zero position, the pump is increased until the position of the linear actuator is incrementally above the zero position. Then, the pump valve is closed.

Next, the tank valve is preset with a high current, on the order of 1.4 amps. Then, the current to the tank valve is incrementally decreased. After each incremental decrease in the current to the tank valve, the position sensor 332 detects if the linear actuator 326 has moved in response to the decrease in tank current. If the linear actuator 326 has not moved, the current to the tank valve is incrementally decreased again. This process continues until movement is detected in the linear actuator 326 by the position sensing device 332. Once motion is detected, the current level at which movement was caused in the linear actuator 326 is averaged and stored. If three or fewer current values have been averaged and stored, as shown in FIG. 14, the next step is to close the pump valve again and continue through the process as described until more than three current values have been stored. Once this process is complete, the average current value is used as the tank quiescent drive in FIG. 11. This process is done for every tank valve on a single-acting actuator. As discussed above, the single-acting cylinders in the embodiment illustrated in FIG. 1 comprise the nose cylinder 38, the left actuator 40, and the right actuator 42.

FIG. 15 illustrates the automatic calibration process 470 for calibrating the pump valve 308 for a single-acting actuator 326 (FIG. 9). First, the pump valve 308 is preset to a relatively low current level, on the order of 0.3 amps. The tank valve 316 is then closed. Next, the current to the pump valve 308 is incrementally increased. If the incremental increase in current to the pump valve 308 causes the position sensing device 332 to detect that the linear actuator 326 has moved, the current level is averaged and stored. If the position sensing device 332 does not detect movement in the linear actuator 326, the current to the pump valve is incrementally increased again and this process continues until movement is detected in the linear actuator 326 by the position sensing device 332. The entire process 470 is repeated until more than three current values have been averaged and stored. The average current value then becomes the quiescent value for the pump quiescent drive 406 in FIG. 11.

FIG. 16 illustrates, in a flow chart format, a process for centering the double-acting linear actuator 372 illustrated in FIG. 10. It should be noted that in the embodiment illustrated in FIG. 1, the sway actuator 44 comprises a double-acting linear actuator.

As shown in FIG. 10, there are four valves, a left pump valve 350, a right pump valve 362, a left tank valve 354, and a right tank valve 356. To begin the centering process 480, the position of the linear actuator 372 is detected by the position sensing device 382. If the position sensing device determines that the position of the linear actuator is more than 10% of the distance between the center point of the actuator device and the fully extended position of the linear actuator device from the center position, the right tank valve 356 is preset to a closed position. Next, the right pump valve 352 is incrementally increased. Then, the position of the linear actuator is then re-checked to determine if the position of the linear actuator is farther to the right of center than 10% of the distance between the center point and the extreme right end of the linear actuator. If it is, the right tank valve 356 is closed again and the right tank value 356 is maintained closed and the right pump valve is incrementally increased until the position of the linear actuator 372 is less than 10% of the distance between the center of the linear actuator and the full extension.

Once the linear actuator is positioned less than 10% of the distance between the center point and the full extended position, it is determined whether the position of the linear actuator is more than 10% of the distance away from the center point to the fully retracted position. If it is, the left tank valve 354 is preset to a closed position and the left pump valve 350 is incrementally increased until the position of the linear actuator is less than 10% the distance away from the center of the linear actuator to the fully retracted position. This completes the centering process. While the centering process may not position the linear actuator in the exact center, the process 480 positions the linear actuator close enough to the exact center for calibration purposes.

FIG. 17 illustrates the process for calibrating the pump valves of a double-acting actuator circuit 490. First, all valves are zeroed. Then, the right tank valve 356 is closed and the right pump valve 352 is closed and provided with a relatively small current, advantageously the small current on the order of the 0.3 amps. Then, the current to the pump valve 352 is incrementally increased until movement is detected in the linear actuator 372 by the position sensing device 382. Once motion is detected, the current value for the right pump valve is stored. This process is repeated until more than three current values have been stored and averaged. Then, the process is complete and the right pump valve is calibrated.

The same process is then undertaken with respect to the left pump valve 350 and the left tank value 354. It must be noted that prior to commencing the process 490 illustrated in FIG. 17, the process 480 at FIG. 16 must first be completed so that the calibration process at 490 is undertaken while the actuator is in a substantially centered position.

FIG. 18 illustrates a process 500 for calibrating the right tank valve at a double-acting linear actuator, such as the linear actuator 372 of FIG. 10. Prior to commencing the process 500, the process 480 illustrated in FIG. 16 must first be undertaken to substantially center the linear actuator. With the linear actuator substantially centered, the left pump valve 350 is preset in a closed position and the left tank valve 354 is preset in an open position. Next, the right tank valve is opened when the right pump valve 352 is slightly opened. The current transmitted to the right tank valve 356 is then incrementally reduced to close the right tank valve slightly. If the incremental change and current to the right tank valve 352 causes the linear actuator 372 to move, as detected by the positioning sensing device 382, the current level is stored. If no movement is detected, the current to the right tank valve 356 is incrementally reduced until motion is detected. Once more than four current values have been stored, they are averaged and are used as the quiescent valve drive for the right tank valve.

The process 500 can also be used to calibrate the left tank valve 354, substituting "left" with "right" with left and right indicators on the full diagram 500. The result of this process for the left tank valve is used for the right tank quiescent drive.

FIG. 19 illustrates a valve manifold 502 according to the present invention. The manifold 502 has mounted thereon a plurality of proportional valves 504. Each proportional valve is substantially surrounded by a solenoid coil 506 as shown, the valve manifold 502 is positioned on a horizontal plate 508 mounted on the back end 90 of the sled 34. Substantially above the manifold 502, a transconductance platform 510 is illustrated for mounting transconductant amplifiers approximately to the proportional valve manifold 502.

The invention may be embodied in other specific forms without departing from the sprit and essential characteristics thereof. The present embodiments, therefore, are to be considered, in all respects, as illustrative and are not restrictive, the scope of the invention being indicated by the appended claims rather than by the foregoing description and all changes which come within the meaning and range of equivalency of the claims are therefore intended to be embraced therein.

What is claimed is:

1. A system for producing smooth motion and smooth reversal of motion in a video driving game or other video game involving vehicle motion or vehicle simulator, comprising:

load;

a single-acting linear actuator coupled to the load;

pressure source;

first and second proportional valves connected in series at a first series connection, the first proportional valve being coupled to the pressure source;

wherein the series connection is coupled to the actuator to permit a flow of fluid to pass from the series connection to the actuator for driving the actuator;

a controller means coupled to receive position commands establishing the desired position of said load and actual position information indicating the actual position of said load and calculating first and second error signals for said first and second proportional valves, respectively, and adding said first and second error signals to first and second quiescent drive signals for said first and second proportional valves, respectively, to generate first and second control signals for said first and second proportional valves, respectively, to control the flow of fluid through the valves to move said load to the desired position smoothly and to automatically calibrate said first and second valves by finding values for said first and second quiescent drive signals which are such that any change in said first or second error signals will cause immediate movements in said load;

wherein the load is selectively moved by the actuator in accordance with signals sent from the controller to the first and second proportional valves.

2. A system for producing translational motion according to claim 1 wherein the controller further comprises a programmed data processor.

3. A system for producing motion, comprising:

load;

a double-acting linear actuator having first and second pressurized fluid input ports and a rod/piston combination coupled to the load;

pressure source;

first and second proportional valves connected in series at a first series connection, the first proportional valve having a fluid input coupled to the pressure source and having a fluid output coupled via said series connection to a fluid input of said second proportional valve;

wherein the series connection between said first and second proportional valves is coupled to said first pressurized fluid input port of the double-acting actuator to permit a flow of fluid to pass from the series connection to the actuator for driving the actuator;

a controller coupled to the first and second proportional valves to provide signals thereto which control the flow of fluid through the valves by driving the first and second valves to different degrees of aperture size in combination;

and, further comprising:

third and fourth proportional valves connected in series at a second series connection, the third proportional valve having an fluid input coupled to the pressure source and having a fluid output coupled via said series connection to a fluid input of said second proportional valve and wherein said second series connection between said third and fourth proportional valves is coupled to said second pressurized fluid input port of said double-acting actuator;

the third and fourth proportional valves also being coupled to the controller for receiving signals therefrom controlling the flow of fluid through the third and fourth proportional valves by driving said third and fourth proportional valves to different degrees of aperture size which, in combination with the different degrees of aperture size established by said controller in said first and second proportional valves, causes said double-acting actuator to extend or retract;

and wherein said controller includes means for generating control signals to said first, second, third and fourth proportional valves to approximately center said double acting actuator and for, at least once, finding the proper quiescent drive signal for each of the first through fourth proportional valves to establish an operating point at a bend point on a drive signal amplitude versus valve aperture area or flow volume function between the region of said function where increasing or decreasing the drive signal amplitude does not affect the aperture area of the valve and the region where increasing or decreasing the drive signal amplitude leads to changes in the valve aperture area.

4. A method of producing smooth motion and smooth reversal of motion in a video driving game or other video game involving vehicle motion or vehicle simulator, comprising the steps of:

providing a load;

providing a linear single-acting actuator mechanically coupled to the load and having a fluid inlet port for receiving pressurized fluid which will cause said actuator to lift said load against the force of gravity;

providing a source of fluid under pressure;

providing pump and tank proportional valves coupled in series at a first series connection, said pump proportional valve having a fluid input coupled to receive said fluid under pressure and having a fluid output coupled to a fluid input of said tank proportional valve via said first series connection, each of said pump and tank proportional valves having control inputs for receiving control signals with said pump proportional valve being normally closed when the magnitude of a control signal at its control input is zero and with said tank proportional valve being normally open when the magnitude of a control signal at its control input is zero;

and wherein said first series connection is coupled to said pressurized fluid inlet port of said linear single-acting actuator;

performing a computerized trial and error process to determine individual quiescent control signal values for each of said pump and tank proportional valves which will establish the control signal values applied to each of said pump and tank proportional valves, respectively, at times when an intermediate control signal value for said pump and tank proportional valves, respectively, is zero, and wherein said individual quiescent control signal values for each of said pump and tank proportional valves will be added to any nonzero intermediate control signal values for each of said pump and tank proportional valves, respectively, at all other times, said quiescent control signal value for said pump and tank proportional valves being set to values such that any increase in said intermediate control signal value above zero for either said pump or tank proportional values will cause immediate movement of said load as soon as the resulting change in the valve aperture of the valve whose intermediate control signal changed changes the amount of hydraulic fluid in said single-acting actuator;

receiving a desired position signal and an actual position signal and calculating error signal therefrom;

using said error signal to calculate said intermediate control signal for each of said pump and tank proportional valves, and adding said quiescent control signal value for said pump proportional valve to said intermediate control signal for said pump proportional valve to generate a control signal for said pump proportional valve, and adding said quiescent control signal value for said tank proportional valve to said intermediate control signal for said tank proportional valve to generate a control signal for controlling said tank proportional valve; and driving first and second amplifiers, respectively, with said control signals for said first and second proportional valves, and applying the output signals of said first and second amplifiers, respectively, to said control signal inputs of said first and second proportional valves to cause said linear actuator to produce the desired movement of said load.

5. A method of producing smooth motion and smooth reversal of motion in a video driving game or other video game involving vehicle motion or vehicle simulator, comprising the steps of:

providing a load;

providing a linear double-acting actuator mechanically coupled to the load and having a first fluid inlet port for receiving pressurized fluid which will cause said actuator to extend and a having a second fluid inlet port for receiving pressurized fluid which will cause said actuator to retract;

providing a source of fluid under pressure;

providing first and second proportional valves coupled in series at a first series connection, said first proportional valve having a fluid input coupled to receive said fluid under pressure from said source of fluid under pressure, and having a fluid output coupled to a fluid input of said second proportional valve via said first series connection, each of said first and second proportional valves having control inputs for receiving control signals with said first proportional valve being normally closed when the magnitude of a control signal at its control input is zero and with said second proportional valve being normally open when the magnitude of a control signal at its control input is zero;

and wherein said first series connection is coupled to said first pressurized fluid inlet port of said linear double-acting linear actuator;

providing third and fourth proportional valves coupled in series at a second series connection, said third proportional valve having a fluid input coupled to receive said fluid under pressure from said source of fluid under pressure, said third proportional valve having a fluid output coupled to a fluid input of said fourth proportional valve via said second series connection, each of said third and fourth proportional valves having control inputs for receiving control signals with said third proportional valve being normally closed when the magnitude of a control signal at its control input is zero and with said fourth proportional valve being normally open when the magnitude of a control signal at its control input is zero;

and wherein said second series connection is coupled to said second pressurized fluid inlet port of said linear double-acting linear actuator;

performing a computerized trial and error process to determine values of control signals for each of said first, second, third and fourth proportional valves to approximately center said linear double-acting actuator between a fully extended and fully retracted position and using said control signals to center said actuator;

performing a computerized trial and error process to determine individual quiescent control signal values for each of said first, second, third and fourth proportional valves said individual quiescent control signal values being those which will establish the control signal values applied to each of said first, second, third or fourth proportional valves, respectively, at times when an intermediate control signal value for said first, second, third or fourth proportional valve, respectively, is zero, and wherein said individual quiescent control signal values for each of said first, second, third and fourth proportional valves will be added to any nonzero intermediate control signal values for each of said first, second, third and fourth proportional valves, respectively, at all other times, said quiescent control signal value for said first, second, third and fourth proportional valves being set to values such that any increase in said intermediate control signal value above zero for any of said first, second, third or fourth proportional values will cause immediate movement of said load as soon as the resulting change in the valve aperture of the valve whose intermediate control signal changed changes the amount of hydraulic fluid in said double-acting actuator;

receiving a desired position signal and an actual position signal and calculating an error signal therefrom;

using said error signal to calculate said intermediate control signal for each of said first and second proportional valves, and adding said quiescent control signal value for said first proportional valve to said intermediate control signal for said first proportional valve to generate a control signal for said first proportional valve, and adding said quiescent control signal value for said second proportional valve to said intermediate control signal for said second proportional valve to generate a control signal for controlling said second proportional valve;

using an inverted version of said error signal to calculate an intermediate control signal for each of said third and fouth proportional valves, and adding said quiescent control signal value for said third proportional valve to said intermediate control signal for said third proportional valve to generate a control signal for said third proportional valve, and adding said quiescent control signal value for said fourth proportional valve to said intermediate control signal for said fourth proportional valve to generate a control signal for controlling said fouth proportional valve;

driving first and second amplifiers, respectively, with said control signals for said first and second proportional valves, and applying the output signals of said first and second amplifiers, respectively, to said control signal inputs of said first and second proportional valves;

driving third and fourth amplifiers, respectively, with said control signals for said third and fourth proportional valves, and applying the output signals of said third and fourth amplifiers, respectively, to said control signal inputs of said third and fourth proportional valves thereby causing desired movement of said load.

6. A method of producing smooth motion and smooth reversal of motion in a video driving game or other video game involving vehicle motion or vehicle simulator, comprising the steps of:

providing a load;

providing a linear single-acting actuator coupled to the load;

providing a source of fluid under pressure;

providing first and second proportional valves coupled in series at a first series connection, said first proportional valve having a fluid input coupled to receive said fluid under pressure and having a fluid output coupled to a fluid input of said second proportional valve via said first series connection, the first series connection being coupled to the linear single-acting actuator;

controlling the first and second proportional valves to produce a first fluid pressure at the first series connection by receiving position commands establishing the desired position of said load and actual position information indicating the actual position of said load and calculating first and second intermediate drive signals for said first and second proportional valves, respectively, and adding said first and second intermediate drive signals to first and second quiescent drive signals for said first and second proportional valves, respectively, to generate first and second control signals for said first and second proportional valves, respectively to move said load to the desired position smoothly, and automatically calibrating said first and second proportional valves by finding values for said first and second quiescent drive signals which are such that any change in said first or second intermediate drive signals will cause immediate movements in said load;

driving the linear single-acting actuator to move the load according to the fluid pressure at the first series connection.

7. A method of producing motion according to claim 6, wherein the controlling step further comprises:

determining an actual position of a location of the load;

determining a desired position of the location of the load;

comparing the actual position with the desired position;

generating an intermediate drive signal according to the difference between the actual position and the desired position;

reducing any effect of valve non-linearity through calculation of said quiescent drive signal.

8. A method of producing motion according to claim 6, further comprising the step of permitting the load to move by gravity.

9. A method of producing motion according to claim 6, wherein the controlling step further comprises:

determining an actual position of a location of the load;

determining a desired position of the location of the load;

comparing the actual position with the desired position;

generating an intermediate drive signal according to the difference between actual position and the desired position.

* * * * *